US007993223B2

(12) United States Patent
Watari et al.

(10) Patent No.: US 7,993,223 B2
(45) Date of Patent: Aug. 9, 2011

(54) BAT FOR BASEBALL OR SOFTBALL

(75) Inventors: Makoto Watari, Yokohama (JP); Katsumi Shimohira, Yokohama (JP); Shuichi Nagashima, Yokohama (JP)

(73) Assignee: Nippon Shaft Co., Ltd, Yokohama-shi, Kanagawa (JP)

( * ) Notice: Subject to any disclaimer, the term of this patent is extended or adjusted under 35 U.S.C. 154(b) by 0 days.

(21) Appl. No.: 12/165,718

(22) Filed: Jul. 1, 2008

(65) Prior Publication Data

US 2009/0280934 A1 Nov. 12, 2009

(30) Foreign Application Priority Data

May 9, 2008 (JP) ..... 2008-123266

(51) Int. Cl.
*A63B 59/06* (2006.01)

(52) U.S. Cl. ..... 473/566

(58) Field of Classification Search ..... 473/457, 473/519, 520, 564–568
See application file for complete search history.

(56) References Cited

U.S. PATENT DOCUMENTS

| | | | | |
|---|---|---|---|---|
| 5,954,602 | A * | 9/1999 | Eggiman et al. | 473/566 |
| 6,776,735 | B1 | 8/2004 | Belanger et al. | |
| 6,808,464 | B1 * | 10/2004 | Nguyen | 473/566 |
| 6,872,156 | B2 * | 3/2005 | Ogawa et al. | 473/567 |
| 6,875,137 | B2 | 4/2005 | Forsythe et al. | |
| 6,969,330 | B1 | 11/2005 | Meeker | |
| 7,014,580 | B2 * | 3/2006 | Forsythe et al. | 473/566 |
| 7,033,291 | B1 | 4/2006 | Meeker | |
| 7,128,670 | B2 * | 10/2006 | Souders et al. | 473/567 |
| 7,361,107 | B2 | 4/2008 | Giannetti et al. | |
| 7,534,180 | B1 | 5/2009 | Vacek et al. | |
| 7,749,115 | B1 | 7/2010 | Cruz et al. | |
| 7,850,554 | B2 | 12/2010 | Burger | |
| 7,867,114 | B2 | 1/2011 | Sutherland et al. | |
| 2002/0091022 | A1 | 7/2002 | Fritzke et al. | |
| 2002/0094892 | A1 | 7/2002 | Chauvin et al. | |

(Continued)

FOREIGN PATENT DOCUMENTS

JP 05-057042 3/1993

(Continued)

OTHER PUBLICATIONS

Japanese Office Action (Application No. 2009-030362) dated May 26, 2010 with English partial translation.

(Continued)

*Primary Examiner* — Mark S Graham
(74) *Attorney, Agent, or Firm* — Nixon Peabody LLP; Jeffrey L. Costellia

(57) ABSTRACT

A bat for baseball or softball of the present invention includes a first tube having an impact part, a step part and a stopper part, a cylindrical second tube, a fixing component being inserted between the first tube and second tube, the step part having an exterior diameter larger than that of the impact part and smaller than an interior diameter of the second tube, the stopper part having an exterior diameter larger than that of the step part and large than the interior diameter of the second tube, the second tube is held of an exterior periphery of the impact part, one end of the second tube is fixed between the stopper part and the step part by an adhesive and the other end is fixed by an adhesive on the fixing component, and a crevice is formed between the first tube and the second tube.

7 Claims, 18 Drawing Sheets

(a) THE LONGITUDINAL DIRECTION NOTCH SECTIONAL VIEW

U.S. PATENT DOCUMENTS

| | | | | |
|---|---|---|---|---|
| 2003/0153416 | A1* | 8/2003 | Anderson | 473/566 |
| 2004/0053716 | A1 | 3/2004 | Wu | |
| 2004/0224802 | A1 | 11/2004 | Forsythe et al. | |
| 2006/0258490 | A1* | 11/2006 | Fitzgerald et al. | 473/564 |
| 2008/0070726 | A1 | 3/2008 | Watari et al. | |
| 2009/0280935 | A1 | 11/2009 | Watari et al. | |
| 2010/0125014 | A1 | 5/2010 | Watari et al. | |
| 2011/0105255 | A1 | 5/2011 | Watari et al. | |

FOREIGN PATENT DOCUMENTS

| | | |
|---|---|---|
| JP | 11-137752 | 5/1999 |
| JP | 2001-079131 | 3/2001 |
| JP | 2003-019236 | 1/2003 |
| JP | 2004-267478 | 9/2004 |
| JP | 2005-245943 | 9/2005 |
| JP | 2005-305146 | 11/2005 |
| JP | 2008-029620 | 2/2008 |
| JP | 57-185374 | 6/2010 |
| WO | WO 00-23151 | 4/2000 |

OTHER PUBLICATIONS

Japanese Office Action (Application No. 2009-030362) dated Aug. 31, 2010 with English partial translation.

Office Action of co-pending (U.S. Appl. No. 12/494,357) mailed Jan. 12, 2011.

International Search Report issued in International Application No. PCT/JP99/03723, dated Nov. 9, 1999.

* cited by examiner (a) THE LONGITUDINAL DIRECTION NOTCH SECTIONAL VIEW (b) LINE α-α' SECTIONAL VIEW (a) THE LONGITUDINAL DIRECTION NOTCH SECTIONAL VIEW (b) LINE β-β' SECTIONAL VIEW (a) THE LONGITUDINAL DIRECTION NOTCH SECTIONAL VIEW (b) THE LONGITUDINAL DIRECTION SURFACE VIEW (a) THE LONGITUDINAL DIRECTION SURFACE VIEW (b) THE LONGITUDINAL DIRECTION NOTCH SECTIONAL VIEW (b) LINE A-A' SECTIONAL VIEW (a) THE LONGITUDINAL DIRECTION
NOTCH SECTIONAL VIEW (b) LINE B-B' SECTIONAL VIEW

BAT FOR BASEBALL OR SOFTBALL

CROSS REFERENCE TO RELATED APPLICATION

This application is based upon and claims the benefit of priority from the prior Japanese Patent Application No. 2008-123266, filed on May 9, 2008, the entire contents of which are incorporated herein by reference.

BACKGROUND OF THE INVENTION

1. Field of the Invention

This invention relates to improving the rebound characteristics of a bat for baseball or softball.

2. Description of the Related Art

Conventionally, the flying distance of a ball is thought to be extended when hit by a high strength bat. This is because it was considered that a bat with a high degree of strength has excellent rebound characteristics and the flying distance of a ball depended solely on these rebound characteristics of the bat. However, in recent years, it is understood that a bat which can reduce the consumption of impact energy as ball transformation energy when a ball and bat collide, can extend the flying distance of a ball. In addition, it is understood that the higher the rebound force/power of the bat itself, the further the flying distance of a ball is extended. Thus, as shown in Japanese Laid Open Patent 2001-79131, a double layered bat formed by arranging a further thin metal tube (called "exterior tube" and "interior tube" respectively) on the exterior or the interior of the body of a metal bat is proposed. That is, a crevice is arranged between the bat body and the exterior tube or the bat body and the interior tube. In this way, an attempt is made to extend the flying distance of a ball by reducing the consumption of impact energy as ball transformation energy by bending of a bat's thin tube when a ball is hit.

FIG. 11 is a longitudinal direction notch sectional view and a cross sectional view of the line A-A' in a width direction of one example of a double layered bat. The bat in FIG. 11 is comprised from a bat tip part 1, a bat impact part 2, a bat taper part 3 and a bat grip part 4. An exterior tube 20 fits onto the bat from the bat tip part 1 up to the bat is taper part 3. In the bat taper part 3, the exterior tube 20 is latched to a hollow for latching 70 which is arranged on the bat by a swaging process or spinning process. At this time, the exterior tube 20 is latched so that a fixed crevice is arranged between the bat and the exterior tube 20. Here the grip part 4 is the part of the bat which is held by a batter and is the thinnest part of the bat which extends to a predetermined length from the end of the grip. The taper part 3 is the part which has a diameter which gradually becomes larger from the grip part 4. In addition, the bat tip part 1 is the part which is formed by a resin for example, and is the end of the bat located in the furthest position from the grip end. The bat impact part 2 is the part except the bat tip part 1, the bat taper part 3 and the bat grip part 4, and which extends to a predetermined length towards the bat tip part 1 from the widest part of the taper part 3 part (in the case of a double layered bat, both an exterior tube and an interior tube of a double layered structure located at the part which extends to a predetermined length towards the bat tip part 1 from the widest part of the taper part 3 part). The bat impact part 2 is generally the part which is suitable for hitting a ball. Furthermore, depending on the manufacturing method, the tip part is sometimes formed as a part of the bat impact part 2 from metal and in this case, the bat is comprised of the bat impact part 2, the bat taper part 3 and the bat grip part 4.

This double layered bat requires latching two tubes during final processing by a swaging process for example. In this case, in order to remove processing distortions, a heat treatment is performed after swaging processing and stress must be released. However, control of a heat treatment of a part having a double layered structure is difficult and securing sufficient strength and durability is also difficult. Particularly, in the case where the material of the bat body and exterior tube or bat body and interior tube are different, because the melting point of each material is also different, control of the temperature and time of a heat treatment becomes complex.

However, as another approach, a recess part is arranged in the metal bat and a layer of urethane is formed on this recess part, as shown in Japanese Laid Open Patent 2005-305146. In the present specification, this type of bat is called a hybrid type double layered bat. FIG. 12 is a longitudinal direction notch sectional view and a cross sectional view of the line B-B' in a width direction of one example of a hybrid type double layered bat. In FIG. 12, the diameter of the bat impact part 2 of the bat body 10 is reduced smoothly by a swaging process for example, from a boundary with the bat tip part 1 and from a boundary with the bat taper part 3 in the direction of the interior of the bat impact part 2. Then, a flexible layer of urethane 101 is formed to cover/enclose the bat body 10 and a hard layer of urethane 102 is formed on the exterior surface. In this hybrid type bat, when a ball collides with the bat, the two layers of urethane (101 and 102) contract and consumption of the impact energy as ball transformation energy is reduced as much as possible and the flying distance of the ball can be extended. However, because an urethane layer deteriorates by secular distortion, the durability of the bat is inferior compared to a metal manufactured bat. In addition, the bat also suffered from an increase in miss hits.

Thus, as shown in Japanese Laid Open Patent 2008-29620, a double layered bat was manufactured using a fixing component.

BRIEF SUMMARY OF THE INVENTION

A bat for baseball or softball related to one embodiment of the present invention includes; a first tube having a grip part, a taper part, an impact part, a tip part, a step part having a larger exterior diameter than an exterior diameter of the impact part and the first tube also including a stopper part having a larger exterior diameter than the exterior diameter of the step part; a cylindrical second tube having two ends which are open, and having an interior diameter which is larger than the exterior diameter of the step part of the first tube and smaller than the exterior diameter of the stopper part of the first tube; a fixing component including a body part and an insertion part, the insertion part being inserted between the first tube and the second tube, the fixing component latching the second tube to an exterior periphery of the first tube; and a crevice located between the first tube and the second tube, the crevice being formed by the second tube being attached to an exterior periphery of the impact part of the first tube, one end of the second tube being fixed between the step part of the first tube and the stopper part by an adhesive, and the other end of the second tube being fixed by the adhesive with the insertion part of the fixing component, the fixing component being inserted between the second tube and the first tube.

A bat for baseball or softball related to one embodiment of the present invention includes; a first tube having a grip part, a taper part, an impact part and a tip part, a step part having a larger exterior diameter than an exterior diameter of the impact part, a first stopper part having a larger exterior diameter than an exterior diameter of the step part and the first tube also including a second stopper part having a larger exterior diameter than the exterior diameter of the first stopper part; a cylindrical second tube having two ends which are open, and having an interior diameter which is larger an exterior diameter of the step part of the first tube and smaller than the exterior diameter of the first stopper part of the first tube; a cylindrical third tube having two ends which are open, and also having an interior diameter which is larger than an exterior diameter of the second tube and smaller than the exterior diameter of the second stopper part of the first tube; a fixing component including a body part, an insertion part and a fixing component stopper part, the insertion part being inserted between the first tube and the second tube, and the fixing component stopper part which forms a crevice between the second tube and the third tube, the fixing component latching the second tube and the third tube to an exterior periphery of the first tube, a first crevice located between the second tube and the first tube, the first crevice being formed by the second tube being attached to an exterior periphery of the impact part of the first tube, one end of the second tube being fixed between the step part of the first tube and the first stopper part by an adhesive, and the other end of the second tube being fixed by the adhesive with the insertion part of the fixing component, the fixing component being inserted between the second tube and the first tube; and a second crevice located between the third tube and the second tube, the second crevice being formed by the third tube being attached to an exterior periphery of the second tube, one end of the third tube being fixed between the first stopper part of the first tube and the second stopper part by the adhesive and the other end of the third tube being fixed by the adhesive with the fixing component stopper part of the fixing component.

A bat for baseball or softball related to one embodiment of the present invention includes; a first tube having a grip part, a taper part, an impact part, a tip part, a step part having a larger exterior diameter than an exterior diameter of the impact part and the first tube also including a stopper part having a larger exterior diameter than the exterior diameter of the step part; a plurality of cylindrical second tubes each having two ends respectively, the ends being open, and each of the plurality of second tubes having an interior diameter and an exterior diameter which are the same respectively, the interior diameter of each of the plurality of second tubes being larger than the exterior diameter of the step part of the first tube and smaller than the exterior diameter of the stopper part of the first tube, and at least one of the plurality of second tubes being formed from a material which is different to the other a tubes; a first fixing component including a body part and an insertion part, the insertion part being inserted between the first tube and the second tube, the first fixing component latching the second tube to an exterior periphery of the first tube; a second fixing component latching the plurality of second tubes to the exterior periphery of the first tube; and a crevice located between the first tube and the plurality of second tubes, the crevice being formed by each of the plurality of second tubes being attached to the exterior periphery of the impact part of the first tube, an end of one of the plurality of second tubes being fixed between the step part of the first tube and the stopper part by an adhesive, the other end of one of the plurality of second tubes being fixed by the adhesive with the second fixing component, an end of another one of the plurality of second tubes being fixed by the adhesive with the second fixing component, the other end of another one of the plurality of second tubes being fixed by the adhesive with the first fixing component, and both ends of yet another one or more second tubes of the plurality of second tubes being fixed by the adhesive with the second fixing component.

In addition, the bat for baseball or softball according to this invention, may further comprise a cap, the cap having a cap tip part, a recessed part and a fixing part, a tip of the tip part of the first tube having a curled part which curves inwards, an exterior diameter of the fixing part of the cap being smaller than an interior diameter of the first tube from the curled part to the stopper part, and an exterior diameter of the recessed part of the cap being smaller than an interior diameter of the curled part of the first tube and the recessed part being latched by the curled part.

The bat for baseball or softball according to this invention, wherein a tip of the tip part may curve inwards and may be closed.

The bat for baseball or softball according to this invention, may to further comprise a spacer, the spacer being inserted between the first tube and the second tube, the first tube includes a stopper part having a larger exterior diameter than an exterior diameter of the impact part and a larger exterior diameter than an interior diameter of the second tube, and the second tube is attached to an exterior periphery of the impact part of the first tube, and one end of the second tube is fixed to a tip of a tip part side of the impact part of the first tube by the adhesive and the spacer, and the other end of the second tube being fixed by the adhesive with the insertion part of the fixing component, the fixing component being inserted between the second tube and the first tube, and the crevice being formed between the first tube and the second tube.

The bat for baseball or softball according to this invention, wherein the first tube may include a groove in a place of a taper part side of the impact part, the fixing component further having a protrusion part on a side in which the insertion part faces a first tube, the fixing component being inserted between the first tube and the second tube, and the protrusion part being fitted with the groove of the first tube.

The bat for baseball or softball according to this invention, wherein the first tube may be formed from an aluminum alloy or an alloy steel and the second tube may be formed from titanium, a titanium alloy, a magnesium alloy or an alloy steel.

The bat for baseball or softball according to this invention, wherein the first tube may further include a second step part having a larger exterior diameter than an exterior diameter of the impact part, the exterior diameter of the second step part being smaller than an interior diameter of the second tube, and also includes a second stopper part having a larger exterior diameter than the exterior diameter of the second step part, the exterior diameter of the second stopper part being larger than the interior diameter of the second tube, the second tube is attached to an exterior periphery of the impact part of the first tube, and wherein one end of the second tube is fixed by the adhesive between the step part of the first tube and the stopper part of the first tube, the other end of the second tube is fixed by the adhesive between the second step part of the first tube and the second stopper part of the first tube, and the second stopper part is formed so that the second stopper part has a larger exterior diameter than an interior diameter of the second tube after the second tube is fixed between the stopper part and the step part and also between the second step part and the second stopper part.

The bat for baseball or softball according to this invention, wherein the stopper part may be formed in a position at least 100 mm or more from a tip of the tip part of the first tube, and the second tube is arranged in the best position for an impact.

BRIEF DESCRIPTION OF THE DRAWINGS

FIG. 1(*b*) shows a cross sectional view of the line α-α' in a width direction of bat for baseball or softball related to embodiment one of the present invention.

FIG. 8(*b*) shows a cross sectional view of the line β-β' in a width direction of a bat for baseball or softball related to embodiment two of the present invention.

FIG. 9(*b*) shows a longitudinal direction notch sectional view of a bat for baseball or softball related to embodiment three of the present invention.

FIG. 10(*b*) shows a longitudinal direction notch sectional view of a bat for baseball or softball related to embodiment four of the present invention.

FIG. 11(*b*) shows a cross sectional view of the line A-A' in a width direction of one example of a double layered bat.

FIG. 12(*b*) shows a cross sectional view of the line B-B' in a width direction of one example of a hybrid type double layered bat.

DETAILED DESCRIPTION OF THE INVENTION

Structure of a Double Layered Bat

The present invention can reduce the consumption of impact energy as ball transformation energy and in particular a bat for baseball or softball is proposed in which the strength of the bat tip part is reinforced. Furthermore, in the present invention, a bat for baseball or softball is proposed which is inexpensive and can be easily manufactured.

Figure 1:
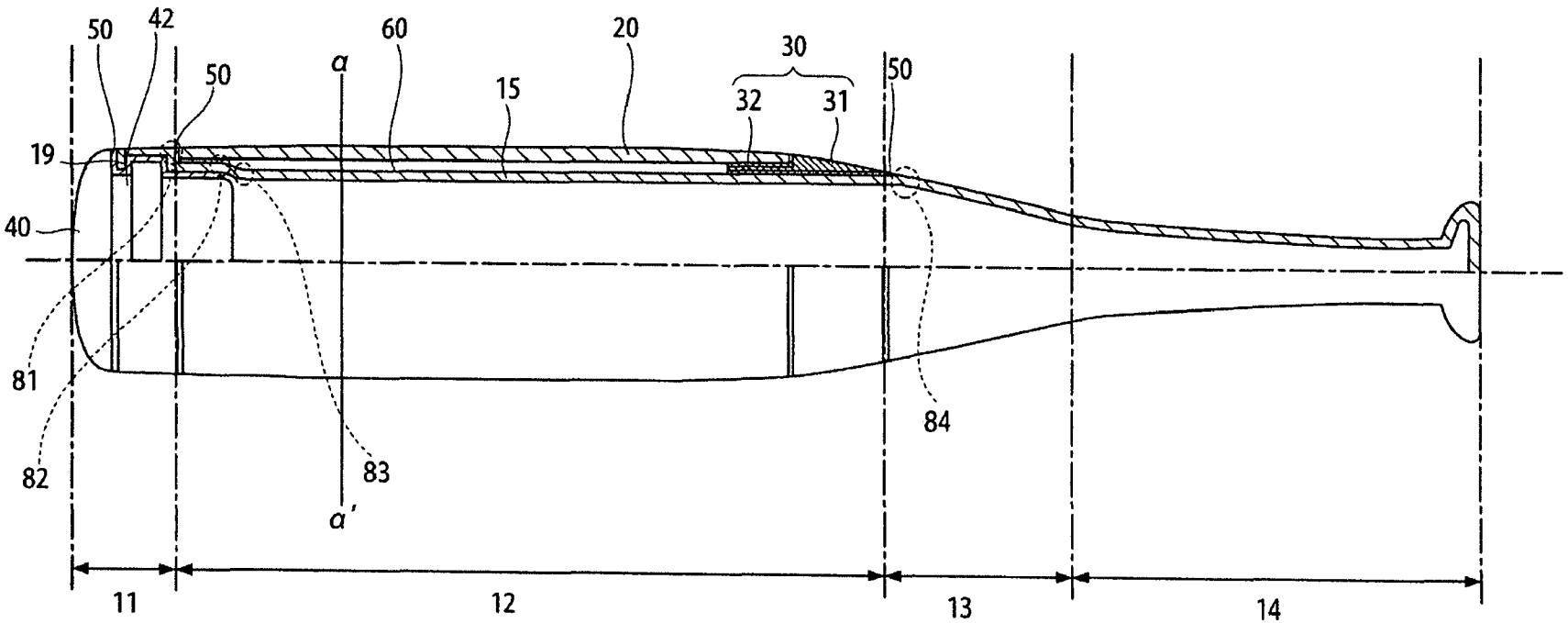
FIG. 1(*a*) shows a longitudinal direction notch sectional view of bat for baseball or softball related to embodiment one of the present invention.
Figure 1:
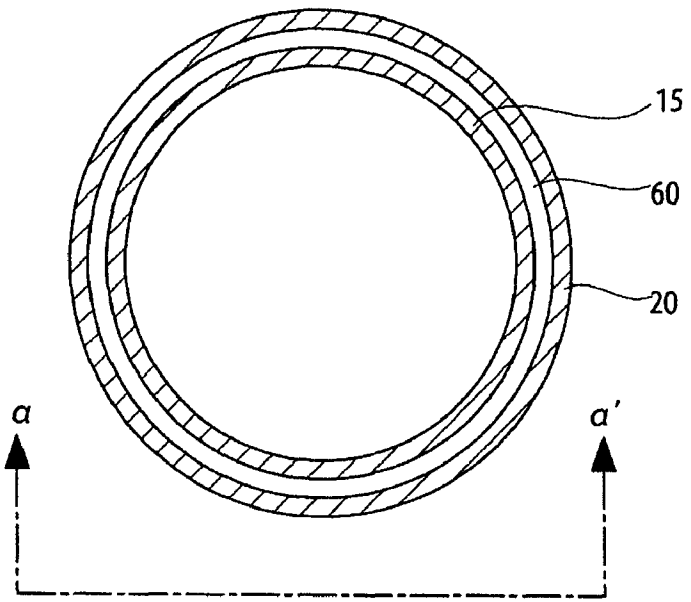
Figure 2:
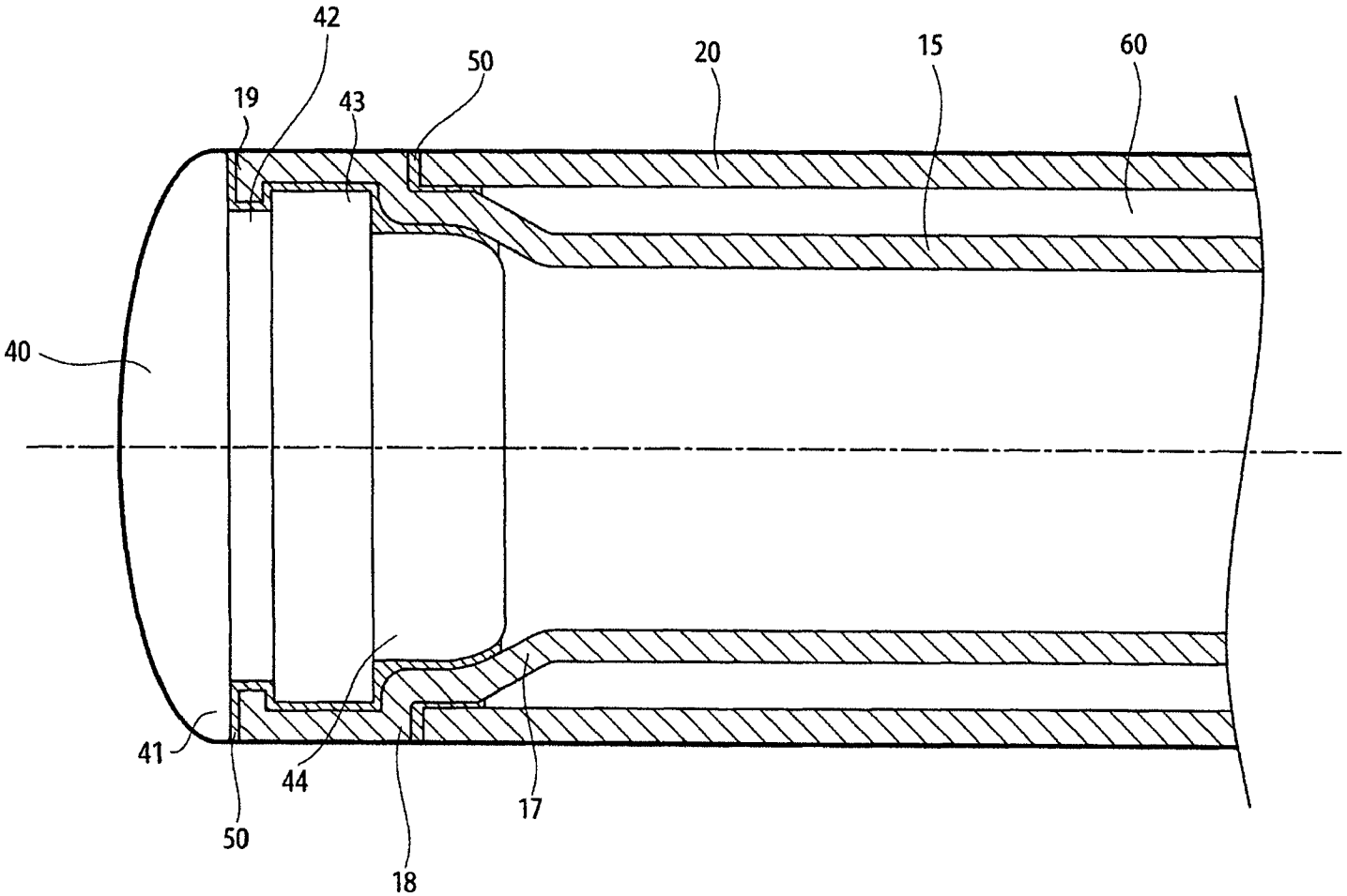
FIG. 2 shows an enlarged cross sectional view in a longitudinal direction of a bat tip part and a bat impact part of a bat for baseball or softball related to embodiment one of the present invention.

The bat for baseball or softball related to embodiment one of the present invention will be explained below based on the diagrams. Furthermore, the same structural components have the same symbols and thus an explanation of these components which overlap between embodiments will be omitted. FIG. 1 is a longitudinal direction notch sectional view and a cross sectional view of the line α-α' in a width direction of bat for baseball or softball related to embodiment one of the present invention. In addition, FIG. 2 is an enlarged cross sectional view in a longitudinal direction of a bat tip part and a bat impact part of a bat for baseball or softball related to embodiment one of the present invention. Furthermore, one example of a bat for baseball or softball of the present invention is shown in the embodiments. However, the bat for baseball or softball of the present invention is not limited to these embodiments.

In FIG. 1, the bat for baseball or softball related to embodiment one of the present invention is roughly comprised of a first tube 15, a second tube 20, a fixing component 30 and a cap 40. The first tube 15 includes a tip part 11, an impact part 12, a taper part 13 and a grip part 14 and the second tube 20 is fixed to the exterior of the impact part 12 of the first tube 15. Furthermore, in embodiment one of the present invention, the second tube 20 is sometimes called an exterior tube 20. In addition, in the bat for baseball or softball related to embodiment one of the present invention, the impact part which hits a ball is formed as one part comprising the impact part 12 of the first tube 15 and the second tube 20, however, for the purposes of explanation, only this part of the first tube 15 is called the impact part 12 below.

In FIG. 1, the first tube 15 is the part which forms the center when a ball is hit by a batter. The batter holds the grip part 14, swings the bat and hits a ball which is thrown. As stated above, the first tube 15 is comprised of roughly four component parts, the tip part 11, the impact part 12, the taper part 13 and the grip part 14 and is generally formed as one body from an aluminum alloy or steel alloy in order to secure lightness and strength. However, the bat is not limited to this. For example, the bat may also be formed by titanium or a titanium alloy. From the viewpoint of ease of manufacturing and cost, the material of the first tube 15 is preferably an A7000 aluminum alloy such as aluminum alloy AA7050, AA7046 regulated under the American Aluminum Association Regulation.

In embodiment one of the present invention, in order to achieve lightness across an entire bat having a double layered structure, the first tube 15 is formed with a thickness of 1 mm-3 mm for example. After the first tube 15 is formed from the above stated metal, a series of heat treatments are performed to remove any processing distortions and secure a certain level of strength. By this method, any stress is released and the first tube 15 becomes usable. Furthermore, the above stated thickness is only an example and not limited to this.

The first tube 15 is formed by processing a thick cylindrical tube using a process means such as a swaging process. In the present embodiment, a tube of aluminum alloy having a diameter within the range of the largest diameter of a bat regulated by baseball rules was used. The diameter of this tube is reduced by processing such as a swaging process from the tip part 11 towards the grip part 14 and the first tube 15 was formed. First, only a certain diameter of this tube was reduced at a first place 81 located at a certain distance from the tip part 11 towards the grip part 14. This certain diameter is equal to the sum of the thickness of the second tube 20 which is the exterior tube and the thickness of an adhesive 50. This first place 81 in which the diameter has been reduced by processing is called a stopper part 18. It is possible to understand the stopper part 18 in detail by referring to FIG. 2. After the exterior tube 20 is attached and the double layered bat is formed the stopper part 18 plays the role of stopping the movement of the exterior tube 20 towards the bat tip part side.

Furthermore, the diameter of the tube is gradually reduced to a certain height (a certain diameter) from a second place 82 located a fixed distance from the stopper part 18 towards the grip part 14 up to a third place 83. This certain height is the height of a crevice 60 which is formed between the first tube 15 and the second tube 20 when the second tube 20 is attached to the first tube 15 by the adhesive 50. Furthermore, the space between the second place 82 up to the third place 83 is called a step part 17. It is possible to understand step part 17 in detail by referring to FIG. 2. In addition, the space from the stopper part 18 of the first tube 15 up to the second place 82 is the part in which the second tube 20 is later fixed by the adhesive 50. In addition, the space from the stopper part 18 up to the second place 82 is a part which plays a role equal to the fulcrum of a spring when the second tube 20 bends at the time of an impact.

Next, the length equal to that of the impact part 12 is processed to the same diameter from the third place 83 towards the grip part 14. Then, the diameter is gradually reduced by a swaging process towards the grip part 14 from a fourth place 84 which is located in a place the same length as the impact part 12 from the third place 83 towards the grip part 14 and the taper part 13 and grip part 14 are formed. The grip end part is sealed off by spinning processing. However, processing of the grip end part is not limited to this. For example, a separate grip end part formed in advance can be latched by a screw and adhesive or welding. The method of forming the grip end can be appropriately selected. The tip of the tip part 11 is curved towards the interior of the bat to a certain length (below this process is called a curling process) and the curled part 19 is formed. In other words, the tip of the tip part 11 is almost bent in a perpendicular direction towards the interior of the bat. The length which is curved should be a length sufficient to latch the cap 40 which is processed by press fit processing, such as 3 mm-10 mm or more preferably 5 mm.

In addition, the method for forming the first tube 15 is not limited to that stated above. That is, first, a desired first tube 15 may be formed in the following way. The diameter of one end of an open cylindrical tube which has an exterior diameter of the impact part 12 is reduced by a swaging process forming the taper part 13 and the grip part 14, and the diameter of the other end of the open cylindrical tube is expanded towards the tip part 11 by a diameter expanding process so that the stopper part 17 and step part 18 are formed. The method of forming the first tune 15 can be appropriately selected. Formation of the grip end by welding or screwing the grip end which is formed separately in advance or by a spinning process, and formation of the curled part 19 by a curling process is the same. Furthermore, the diameter reducing process may be a method other than the above stated swaging process, for example, a stepping process or a tapering process.

The first tube 15 of the bat for baseball or softball related to embodiment one of the present invention has a step part 17 and a stopper part 18 by the above stated process. The exterior diameter of the first tube 15 between the step part 17 and the stopper part 18 is larger than the exterior diameter of the impact part 12 and smaller than the interior diameter of the second tube 20. However, the exterior diameter of the first tube 15 between the step part 17 and the stopper part 18 is slightly smaller than the interior diameter of the second tube 20. Therefore, the second tube 20 is inserted from the grip end side of the first tube 15, one end of the second tube 20 is fitted onto the exterior of the impact part 12 of the first tube 15 by the adhesive 50 and the second tube 20 becomes fixed when the adhesive 50 hardens. In addition, the other end of the second tube 20 is fixed by the fixing component 20, which is explained in detail below, and the adhesive 50. Then, the second tube 20 is latched to the exterior of the impact part 12 of the first tube 15 and a crevice 60 of a certain height is formed between the second tube 20 and the first tube 15.

The exterior diameter of the stopper part 18 is larger than the interior diameter of the second tube 20 and preferably should be the same diameter as the exterior diameter of the second tube 20. In this way, when the completed bat is swung, the second tube 20 tries to move towards the tip part 11 by centrifugal force, however, the movement of the second tube 20 is completely halted by this stopper part 18. The material of the first tube 15 and the second tube 20 is different, as will be explained below, however, because both are formed from a metal alloy, there is no significant difference in a thermal expansion coefficient. Therefore, the second tube 20 is completely fixed to the exterior of the impact part 12 of the first tube 15 and as long as there is no damage to the tip part 11 of the first tube 15, the second tube 20 will not jump out from the tip part 11 side or fall out. Furthermore, the exterior diameter of the stopper part 18 is made the same as the exterior diameter of the second tube 20 because when the bat is completed, the exterior surface of the stopper part 18 and the exterior surface of the second tube 20 are formed as the same surface.

The second tube 20 of the bat for baseball or softball related to embodiment one of the present invention is a cylindrical tube which has two open ends. The interior diameter of the second tube 20 is larger than the exterior diameter of the impact part 12 of the first tube 15. More preferably, the interior diameter of the second tube 20 is about twice as large as the height of the crevice 60 formed between the first tube 15 and the second tube 20 compared with the exterior diameter of the first tube 15. In addition, the second tube 20 may be formed from the same aluminum alloy or steel alloy as the first tube 15 or by a light material having excellent rebound characteristics such as titanium, a titanium alloy or magnesium alloy. Furthermore, the second tube 20 may be formed by a material such as phosphor bronze, a copper alloy, a gold alloy or platinum alloy. Preferably, the second tube 20 is formed from one of the following; titanium, titanium alloy, magnesium alloy or steel alloy. The second tube 20 is formed separately from the first tube 15 and is used after being separately heat treated. Therefore, compared to a usual double layered bat, heat treatment is simple and the particular difficulties involved with heat treating the first tube 15 and second tube 20 when they are formed from different material are removed. The second tube 20 with this material is fixed to the exterior of the impact part 12 of the first tube 15 so that the crevice 60 having a certain desired height is formed. In this way, when a ball is hit, ball transformation energy is absorbed by bending of the impact part which has a double layered structure and the flight distance of the ball can be further extended.

Although not shown in the diagrams, a make-up sheet can be applied to the exterior of the above stated second tube 20 to the purpose of protecting the second tube 20 from damage and for design effect. This make-up sheet can be formed from, for example, a resin film such as a polyethylene film, an elastomer film and a plastic film or an FRP (Fiber Reinforced Plastics) sheet.

The fixing component 30 includes a body part 31 and an insertion part 32. The insertion part 32 has a certain height. This height is the height when the crevice 60 having a certain height is formed between the first tube 15 and the second tube 20 in the case where the insertion part 32 is inserted between the first tube 15 and the second tube 20 and the two tubes fixed by the adhesive 50. In other words, this height is set at a height after the height of the intervening hardened adhesive 50 is subtracted from the certain height of the formed crevice 60. Furthermore, this insertion part 32 plays a role equivalent to the fulcrum of a spring when the second tube 20 bends when a ball is hit.

In the present embodiment a cap 40 is attached to the tip part 11 of the first tube 15 shown in FIG. 1 by press fit processing. When the bat is being used, it is usually thrown after a ball has been hit. In addition, depending on the user, there are times when the tip of bat hits a spike or is dropped in dirt/mud and also hits the ground. The cap 40 acts to protect the bat in these cases. That is, the cap 40 also acts to protect the bat from damage caused by actions other than hitting a ball.

The cap 40 which fulfills this function is formed by a resin in the present embodiment and as stated above, is inserted into the tip of the first tube 15 by press fit processing. The cap 40 will be explained in detail while referring to FIG. 2. As is shown in FIG. 2, the cap 40 is comprised of a cap tip part 41, a cap recessed part 42, a cap fixing part 43 and a cap second fixing part 44. The cap tip part 41 protects the tip part 11 of the first tube 15 after the bat is formed.

The cap recessed part 42 plays the role of fixing the cap 40 to the tip part 11 of the first tube 15 in the case where the cap 40 is inserted into the tip part 11 of the first tube 15 by press fit processing. That is, the exterior diameter of the cap recessed part 42 is smaller than the interior diameter of the curled part 19 of the tip part 11. Therefore, when press fitted, because the curled part 19 cuts into the recessed part 42 of the cap 40, the cap 40 fits onto the tip part 11 of the first tube 15.

The cap fixing part 43 has a larger exterior diameter than the interior diameter of the curled part 19. Therefore, when the cap 40 is once inserted into the tip part 11 of the first tube 15 by press fit processing, this cap fixing part 43 is hooked by the curled part 19 and the cap 40 is prevented from jumping out. Furthermore, at the time of press fit processing, the interior of the tip part 11 of the first tube 15 is applied with the adhesive 50, the adhesive hardens between the exterior of the cap fixing part 43 and the interior of the tip part 11 of the first tube 15 and the cap 40 is more strongly fixed. In the same way the cap second fixing part 44 plays the role of fixing the cap 40 to the tip part 11 of the first tube 15 by the adhesive 50. The cap second fixing part 44 increases the adhesion when the tip is formed according to the shape of the interior of the step part 17.

Figure 3:
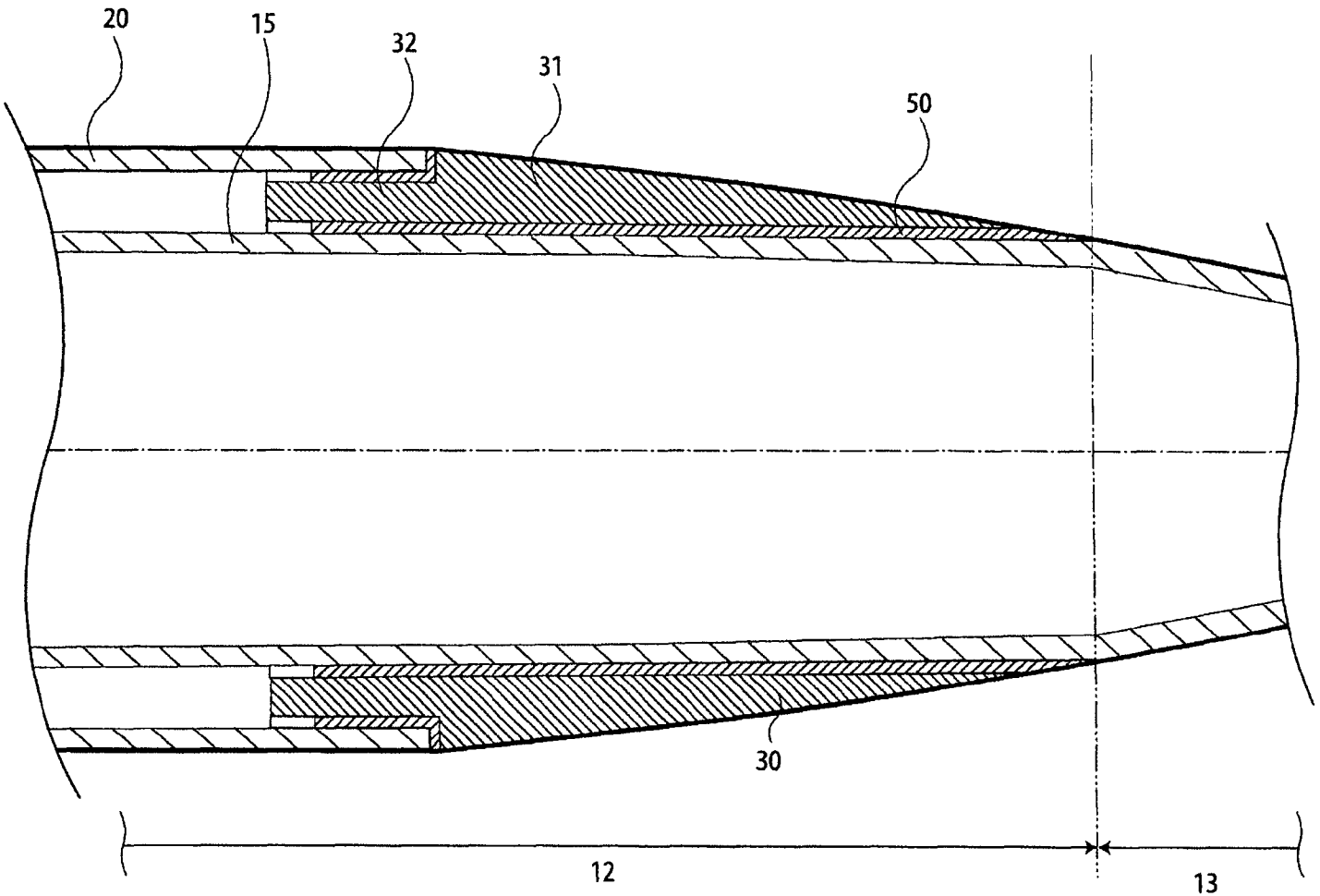
FIG. 3 shows an enlarged cross sectional view in a longitudinal direction of a bat impact part and a taper part of a bat for baseball or softball related to embodiment one of the present invention.

As stated above, the bat for baseball or softball related to embodiment one of the present invention is a double layered bat in which a second tube is attached and fixed to the periphery of an impact part 12 of a first tube 15. The fixing component 30 latches one end of this second tube 20 to the first tube 15. FIG. 3 is an enlarged cross sectional view in a longitudinal direction of a bat impact part and a taper part of a bat for baseball or softball related to embodiment one of the present invention.

As is shown in FIG. 3, the fixing component 30 is formed from a fixing component body 31 and an insertion part 32. The fixing component 30 is a part having a donut shape and a circular hollow space at its center. After the second tube 20 is attached to the first tube 15, the fixing component 30 is attached to the exterior periphery of the first tube 15 from the grip end side of the first tube 15. In addition, the insertion part 32 of the fixing component 30 is inserted between the first tube 15 and the second tube 20. At this time, both surfaces of the insertion part 32 of the fixing component 30 and the interior surface of the body part 31 are applied with the adhesive 50. The fixing component 30 is fixed to the exterior periphery of the first tube 15 by hardening of the adhesive 50 and the second tube 20 is fixed to the exterior periphery of the insertion part 32 of the fixing component 30. Centrifugal force acts on the exterior tube 20 (second tube) of the double layered bat which is formed when a ball is hit and so the exterior tube 20 tries to move towards the bat tip side. Therefore, locking within the bat tip side of the second tube 20 is extremely important. On the other hand, a centrifugal force does not act in the direction of the grip side. Therefore, the latching in these parts does not require strength when compared to latching in the tip part. Therefore, it is possible to obtain a sufficient amount of strength in latching by using the adhesive 50.

Here, the thickness of the insertion part 32 of the fixing component 30 is formed at a predetermined thickness. The adhesive 50 which is applied to both surfaces of the insertion part 32 hardens and the first tube 15 and second tube 20 are latched with a crevice 60 which has a certain height. That is, this predetermined thickness is a thickness of the thickness to which the height of the adhesive 50 which hardens on both surfaces was subtracted from the thickness of the formed crevice 60. In this way, as stated above, the crevice 60 is formed with a desired height Furthermore, the exterior surface of the body part 31 of the fixing component 30 is formed so that its diameter decreases smoothly towards the taper part 13 of the first tube 15 and so that a protrusion is not formed on the exterior surface of the bat.

The above stated fixing component 30 is formed from a plastic or synthetic rubber such as polyurethane, polyamide or polyethylene or a different elastomer material, however, the fixing component material is not limited to this. A synthetic resin, metal or ceramic may also be used.

In FIG. 1, the crevice 60 is formed between the first tube 15 and the second tube 20 as stated above. That is, the crevice 60 is formed when one end of the second tube 20 in which both ends are open is latched to the periphery of a part between the step part 17 and the stopper part 18 of the first tube 15 and the other end is latched to the periphery of the first tube 15 via the insertion part 32 of the fixing component 30 which has a predetermined height. The crevice 60 can be better understood by the cross sectional diagram in a width direction in FIG. 1(*b*). The crevice 60 is located between the second tube 20 and the first tube 15 and is a space for reducing the consumption of impact energy as ball transformation energy when the second tube 20 bends inwards when a ball is hit. Furthermore, the height of this crevice 60 can be adjusted by a predetermined height (that is, a predetermined diameter) by reducing the diameter of the step part 17 (Or expanding the diameter by a processing method). In the present embodiment the height of the crevice 60 is set between 0.1 mm-3.0 mm, for example, depending on the material etc, of the first tube 15 and the second tube 20.

[Effects of the Double Layered Bat]

The bat for baseball or softball having the above structure, related to embodiment one of the present invention is arranged with the crevice 60 between the first tube 15 (interior tube) and the second tube 20 (exterior tube). Then, the exterior tube 20 is formed from a metal having superior rebound characteristics than the interior tube 15. Therefore, when a ball is hit, mainly the exterior tube 20 bends inwards, consumption of the impact energy as ball transformation energy is reduced and because the exterior tube 20 itself has superior rebound characteristics, the flight distance of the ball can be extended.

Second, the tip part 11 of the first tube 15 which acts as the bat's tip is formed from a metal tube, the rigidity of the bat tip part is high. For example, the rigidity of the bat is higher than that of the bat cited in document three. Therefore, even if the ball is hit with the tip end side of this bat, the ball will fly. Furthermore, as stated above, because the bat is formed from metal up to the tip part, the third effect is that durability of the bat is improved.

As stated above, because the cap 40 is inserted into the tip part 11 of the first tube 15 by press fit processing, processing becomes easy. Therefore, the fourth effect is that it is possible to reduce the operational processes of the bat for baseball or softball related to embodiment one of this invention. In addition, there is no need to use complex processes in order to attach the parts and strict processing accuracy of the tip part 11 of the first tube 15 is not demanded. Therefore, it is both possible to reduce the cost of the various parts and therefore the overall manufacturing costs of the bat.

Fifth, safety is improved in the bat for baseball or softball related to embodiment one of this invention. That is, in this bat as stated above, the exterior tube 20 is latched by the stopper part 18 of the metal interior tube 15. Because both tubes are formed from metal, there is no significant difference in a coefficient of thermal expansion and they can be securely latched by adjusting the interior and exterior diameters of the two tubes. Therefore, even if the resin cap 40 is damaged, as long as the interior tube 15 itself is not damaged, the exterior tube 20 will not come loose and jump out and thus safety is improved.

Sixth, the life cycle of the bat for baseball or softball related to embodiment one of this invention is much longer. The bat for baseball or softball related to embodiment one of this invention has a metal, double layered structure, however, the second tube 20 is attached and fixed via the fixing component 30 with the adhesive 50. Therefore, it is possible to easily replace the second tube 20 alone which can cause damage when a ball is hit. In a conventional bat with a metal, double layered structure, because the exterior tube 20 (or the interior tube 15) is latched to the body 10 by a swaging process, even when the exterior tube 20 (or the interior tube 15) is damaged, and it could not be replaced. The life cycle of the bat related to the present embodiment can be made much longer by replacing the exterior tube 20. Furthermore, because the second tube of the bat related to the present embodiment is manufactured from metal, the effects of secular distortion are few and durability is excellent compared to a hybrid type double layered bat.

The consumption of impact energy as ball transformation energy can be reduced by the present invention and in particular a bat for baseball or softball is proposed in which the strength of the bat tip part is reinforced and in addition a bat for baseball or softball is proposed which is inexpensive and can be easily manufactured.

Example One

An example of the bat for baseball or softball related to embodiment one of the present invention will be explained. As stated above, the bat for baseball or softball related to embodiment one of the present invention includes a cap. However, if the entire bat tip can be formed with the first tube 15, the durability of the bat tip part is increased. The present example is an example of forming the bat tip part with the first tube 15.

Figure 4:
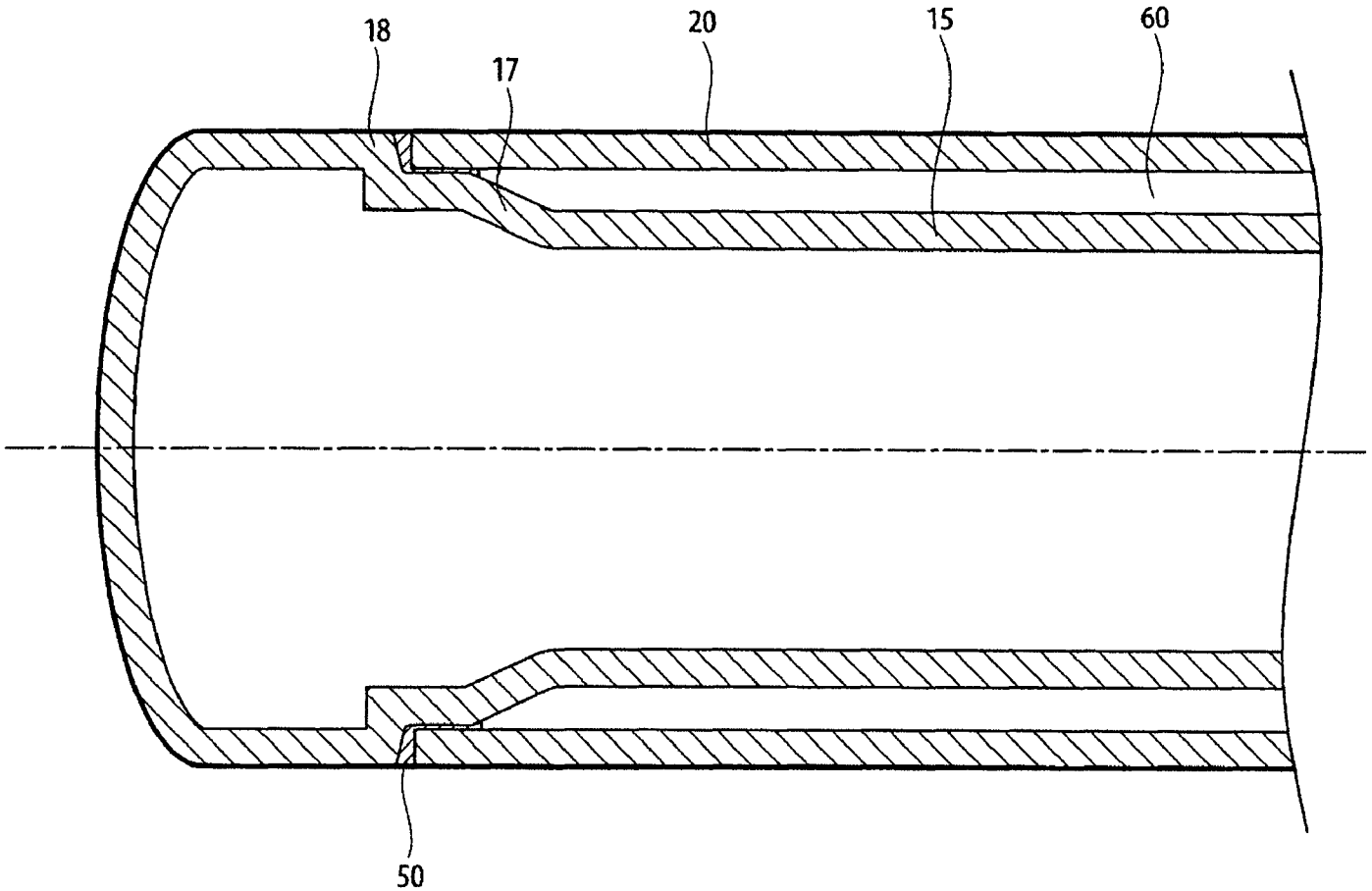
FIG. 4 shows an enlarged cross sectional view in a longitudinal direction of a bat tip part of a bat for baseball or softball related to example one of embodiment one of the present invention.

FIG. 4 is an enlarged cross sectional view in a longitudinal direction of a bat tip part of a bat for baseball or softball related to example one of embodiment one of the present invention. As is shown in FIG. 4, in the present example, the first tube 15 includes the step part 17 and the stopper part 18 and the crevice 60 is formed between the first tube 15 and the second tube 20. In this point, this is the same as the bat for baseball or softball related to embodiment one of the present invention.

In the bat in example one, the bat is formed with the first tube 15 up to the tip of the first tube (that is, bat tip) 15 from the stopper part 18. First, the diameter of one end of the first tube 15, which has two open ends and a predetermined diameter of the impact part 12, is reduced by processing. As a result, the part from the taper part 13 of the first tube 15 to the grip part 14 is formed. After this, the diameter of the other end of the first tube 15 is expanded by processing. As a result, the step part 17 and the stopper part 18 are formed. After this, the diameter of the other end of the first tube 15 is expanded by processing and the step part 17 and the stopper part 18 are formed. Next, without passing through the process for forming the curled part 19, the tip part is closed off by a spinning process. In this way, it is possible to form the bat of the present example which is formed by metal as far as the tip part. Because the second tube 20 and the fixing component 30 are the same as in embodiment one of the present invention, an explanation here has been omitted. Furthermore, the first tube 15 which has a predetermined diameter may be formed by first gradually reducing the diameter of the first tube 15 from the tip part 11, forming the part from the stopper part 18 to the grip part 14 and lastly closing the tip part 11.

Because the bat for baseball or softball related to example one having this structure is formed up to the tip part 11 with metal, the rigidity of the tip part 11 is further increased. In addition, because the bat is formed as one metal part up to the tip part 11, durability is also further improved. The effects of increasing the flight distance of a ball by a double layered structure having a crevice 60, improving safety, increasing the length of the life cycle of the bat and increasing durability compared to a hybrid type bat, are the same as the above stated embodiment one.

Example Two

Figure 5:
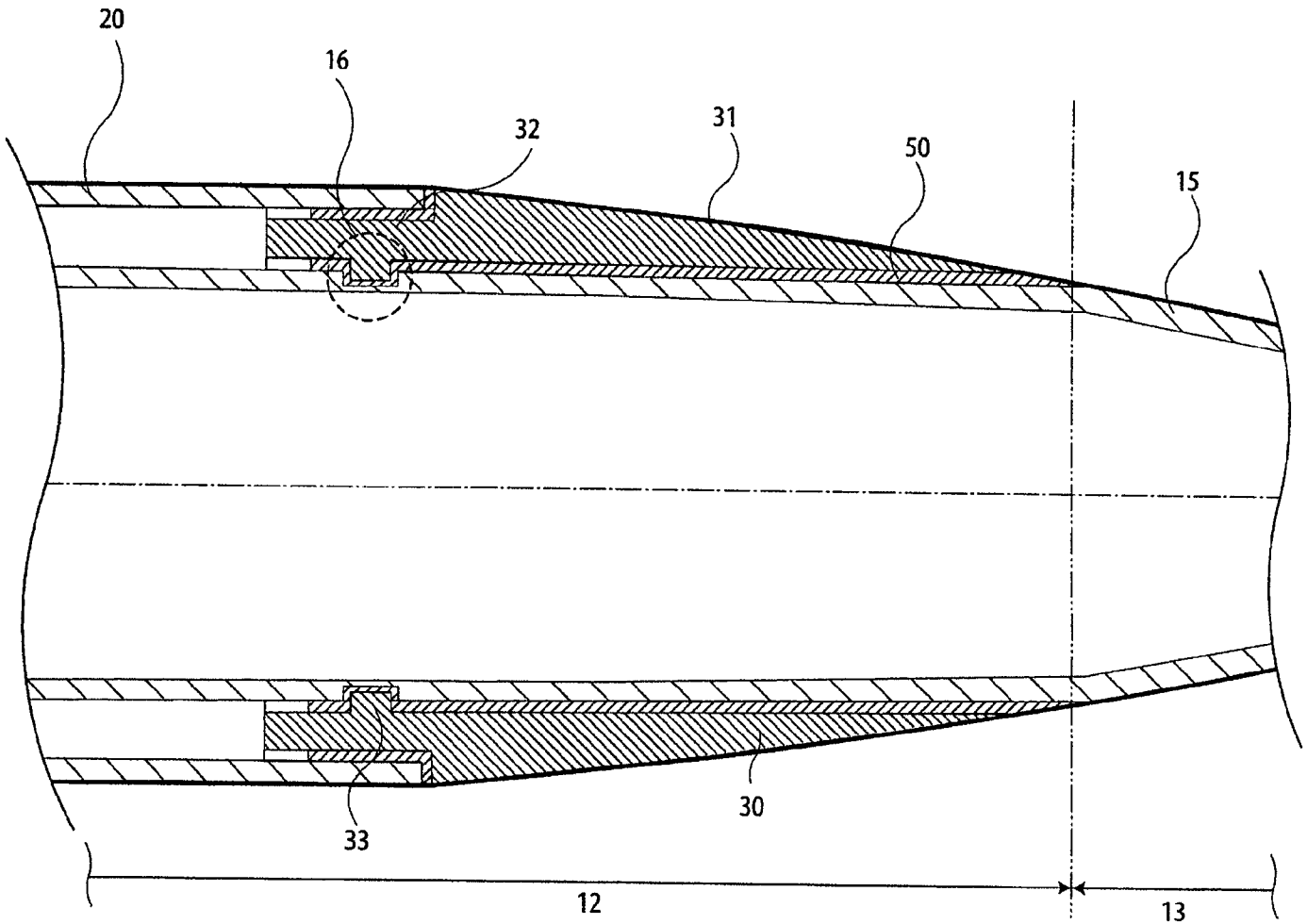
FIG. 5 shows an enlarged cross sectional view in a longitudinal direction of a bat impact part and a taper part of a bat for baseball or softball related to example two of embodiment one of the present invention.

Another example of the bat for baseball or softball related to embodiment one of the present invention will be explained. In the bat for baseball or softball related to embodiment one of the present invention, latching of the second tube 20 near the taper part 13 of the first tube 15 takes place by the fixing component 30 and the adhesive 50. The second example of the bat for baseball or softball related to embodiment one of the present invention is an example of further strengthening fixing of this fixing component to the first tube 15. FIG. 5 is an enlarged cross sectional view in a longitudinal direction of a bat impact part and a taper part of a bat for baseball or softball related to example two of embodiment one of the present invention.

As is shown in FIG. 5, the fixing component 30 related to example two includes a protrusion part 33 in addition to a body part 31 and insertion part 32. Interlocking grooves 16 are formed by a spinning process on a predetermined place of the first tube 15.

The fixing method of the exterior tube 20 of the bat for baseball or softball related to the present example will be explained. First, interlocking grooves 16 are formed during the manufacturing process in predetermined places on the first tube 15. Because the formation method of the taper part 13 etc is the same, an explanation is omitted here. Next, the exterior tube 20 which has two ends which are open is attached to the exterior periphery of the first tube 15 from the grip end side and fixed to the exterior surface between the step part 17 and the stopper part 18 of the first tube 15 by the adhesive 50. Next, the adhesive 50 is applied to the interior of the donut shaped fixing component 30 and then attached to the exterior periphery of the first tube 15 from the grip end side of the first tube 15. The insertion part 32 is inserted between the first tube 15 and the second tube 20 and the protrusion part 33 is interlocked and fixed to the interlocking grooves 16 which are formed in predetermined places of the first tube 15 and fixing is strengthened by hardening of the adhesive 50.

By interlocking and fixing the protrusion part 33 with the interlocking grooves 16 of the first tube 15, it is possible to further strengthen fixing of the second tube 20 in the bat for baseball or softball related to the present example and safety is also improved. During processing of the first tube 15, the number of processes which form the interlocking grooves 16 increases, however, there is no significant extension of the operational processes. The effects of increasing the flight distance of a ball by a double layered structure having a crevice 60, improving safety, increasing the length of the life cycle of the bat, increasing durability and improving rigidity of the bat tip part compared to a hybrid type bat, are the same as the above stated embodiment one and an explanation is omitted here.

Further, example two can be applied to the bat shown in example one. In this case the effects are the same as stated above.

Example Three

Figure 6:
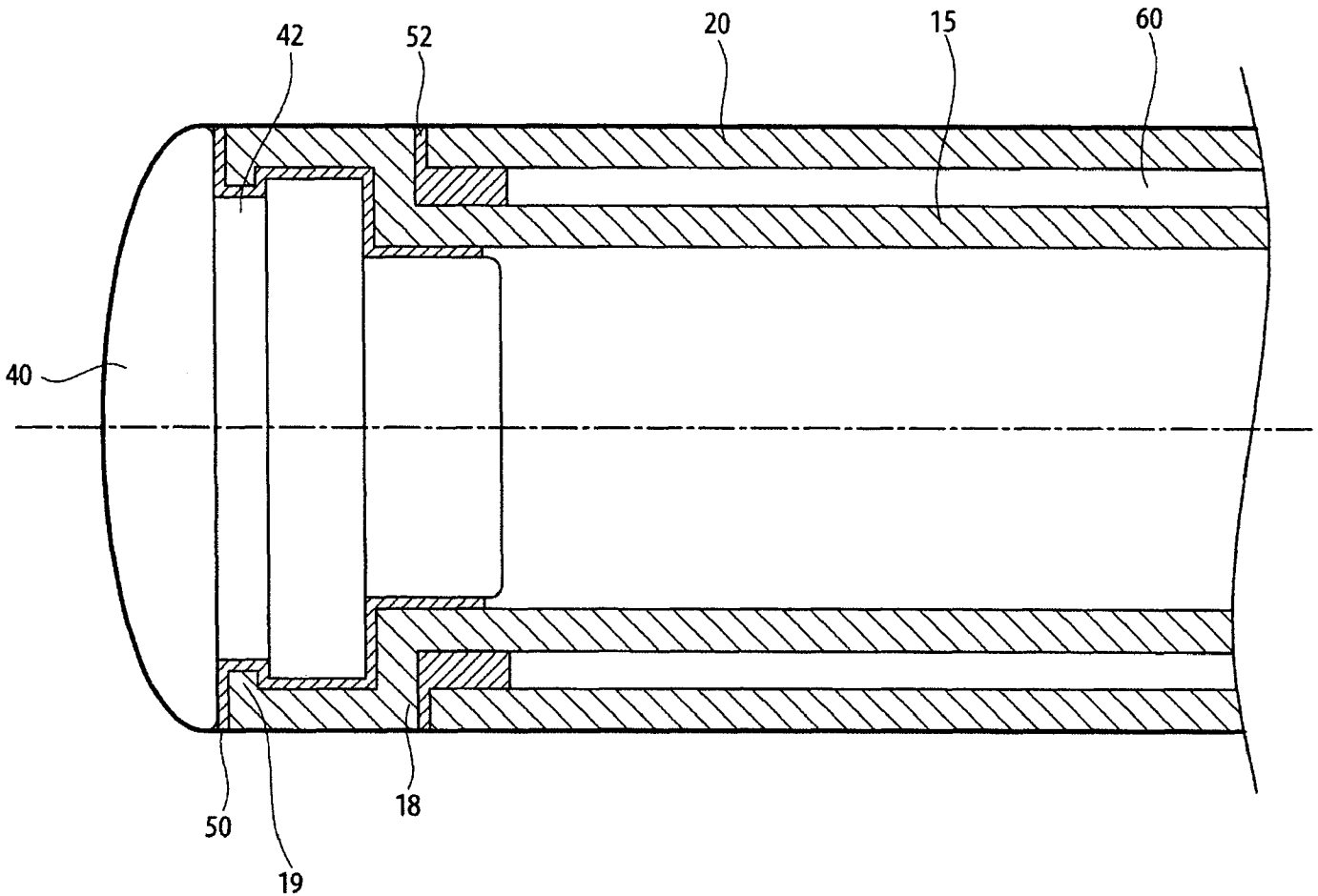
FIG. 6 shows an enlarged cross sectional view in a longitudinal direction of a bat tip part of a bat for baseball or softball related to example three of embodiment one of the present invention.
Figure 7:
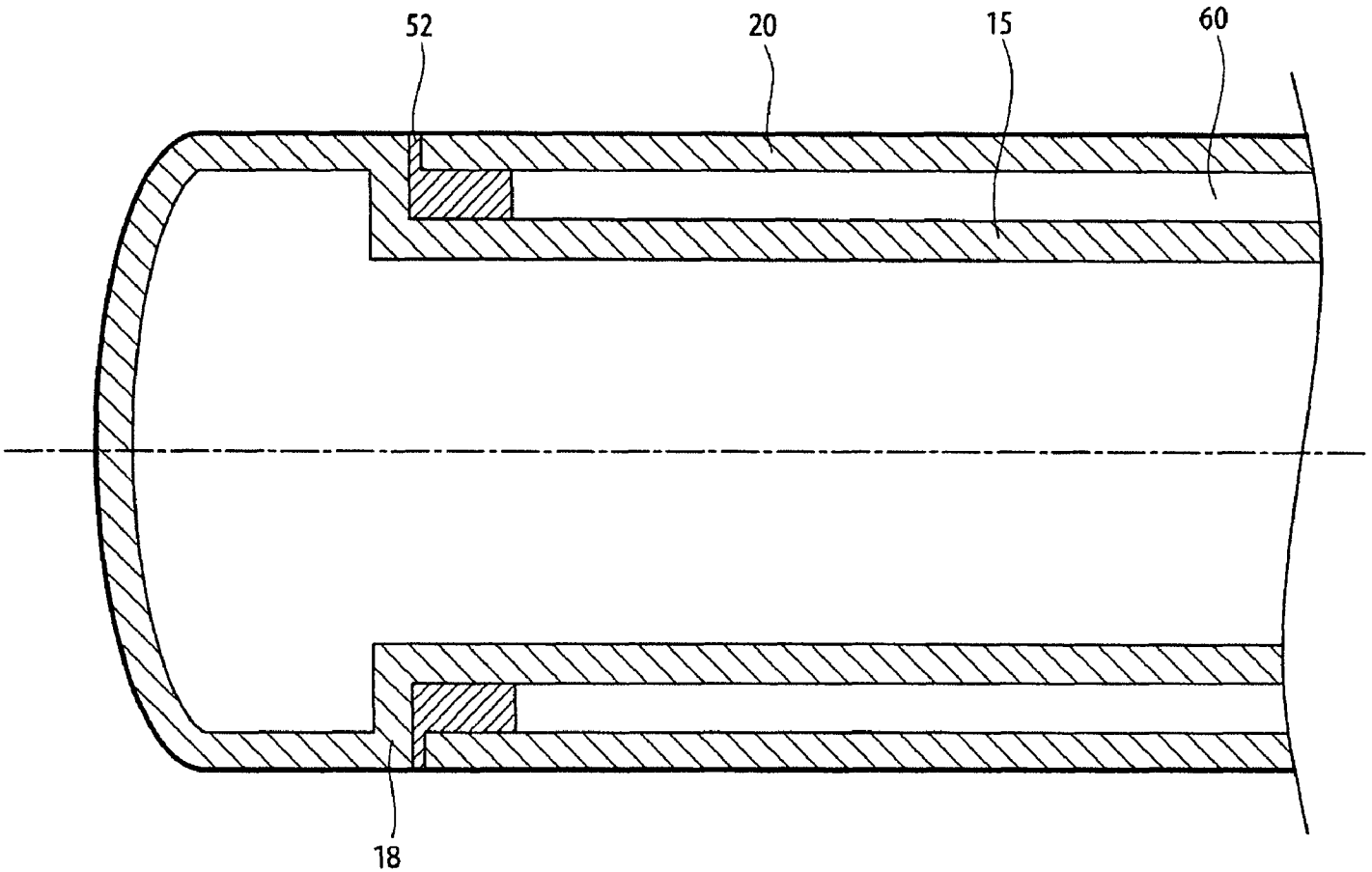
FIG. 7 shows an enlarged cross sectional view in a longitudinal direction of a bat tip part of a bat for baseball or softball related to example three of embodiment one of the present invention.

Another example of the bat for baseball or softball related to embodiment one of the present invention will be explained. As stated above, in the bat for baseball or softball related to embodiment one of the present invention, in order to form the crevice 60 between the first tube 15 and the second tube 20, the step part 17 is arranged on the first tube 15 by a diameter reducing process (or a diameter expanding process). However, if this process is omitted, it is possible to further reduce operational processes and a reduction in manufacturing costs. The bat for baseball or softball related to example three does not include the step part 17 and the crevice 60 is formed by a spacer 52. FIG. 6 and FIG. 7 are enlarged cross sectional views in a longitudinal direction of the tip part of the bat for baseball or softball related to example three of embodiment one of the present invention. FIG. 6 shows a bat with the cap 40 and FIG. 7 shows a bat without the cap.

As shown in FIG. 6 in the bat in example three, the impact part 12 of the first tube 15 extends as far as the tip part 11 and only the stopper part 18 is formed without forming the step part 17. The formation of the curled part 19 after this is also the same. Although the step part 17 can be formed without difficulty by controlling a process machine which smoothly reduces or expands the diameter of the step part 17, the process requires certain period of time. Therefore, in order to reduce this process the bat in example three can be process by significantly reducing the overall operational time.

Latching of the exterior tube 20 of the bad related to example three will be explained. As stated above, the bat of the present example does not include the step part 17, therefore, the crevice 60 exists between the impact part 12 of the first tube 15 and the second tube 20. It is difficult to bury the crevice 60 using only the adhesive 50. Thus, the bat in example three, the first tube 15 and the second tube 20 are fixed by the adhesive 50 via the spacer which has a predetermined height. The height of this spacer 52 is equal to the height of the crevice 60 which is formed between the first tube 15 and the second tube 20.

The spacer 52 is a part which has a hollow center and donut type cylindrical shape, the exterior periphery of the bottom part (not shown in the diagram) is large and the exterior diameter of a side wall part (not shown in the diagram) which extends from the bottom part, is smaller than the exterior diameter of the bottom part. More specifically, the exterior diameter of the bottom part is formed to the same diameter as the exterior diameter of the first tube 15 between the stopper part 18 and the curled part 19 and the exterior diameter of the side wall part is a diameter in which the exterior diameter of the bottom part has been reduced slightly more than the thickness of the second tube 20. That is, the height of the wall part of the spacer 52 is a little lower than the certain height of the crevice 60 formed. Therefore, the thickness of the side wall part of the spacer 52 plays a role equivalent to a fulcrum of a spring when the second tube 20 bends when a ball is hit. Furthermore, the material of the spacer 52 is not limited, however, particularly because it is a part which is arranged between the side wall surface of the stopper part 18 of the first tube 15 and the second tube 20, it is preferably formed from a material having soundproof characteristics so that a metal sound is not produced when the metal tubes contact.

Next, the latching method of the second tube 20 which used the spacer 52 will be explained. The spacer 52 which has the adhesive 50 applied to its entire surface is attached to the first tube 15 from the grip end side. The back surface of the bottom part of the spacer 52 is attached to the stopper part 18 of the first tube 15 by the adhesive 50. Next, before the adhesive 50, which is applied to the spacer 52, hardens, the second tube 20 is attached to the first tube 15 from the grip end side. The height (thickness) of the side wall part of the spacer 52 is smaller than the height of the crevice 60 which is formed. Therefore, the second tube 20 is attached so that it covers the side wall part of the spacer 52. The second tube 20 is fixed and the crevice 60 is formed between the impact part 12 of the first tube 15 and the second tube 20 when the adhesive 50 which is applied, hardens. Furthermore, because the insertion process of the cap 40 is the same as in the above is stated embodiment one, an explanation is omitted here.

Because process of processing the step part of the bat for baseball or softball related to example three having the above stated structure, is omitted, it is possible to further reduce operational processes. Therefore, it is also possible to further reduce manufacturing costs. In addition, the effects of increasing the flight distance of a ball by a double layered structure having a crevice 60, improving safety, increasing the length of the life cycle of the bat, increasing durability and improving rigidity of the bat tip part compared to a hybrid type bat, are the same as the above stated embodiment one and an explanation is omitted here.

Furthermore, example three can also be applied to the bat shown in example one. This example is shown in FIG. 7. The manufacturing process and the effects of this example are the same as those stated above and thus an explanation is omitted here. Furthermore, it is also possible to use the fixing component 30 of the bat in example three which is shown in FIG. 6 and FIG. 7 as the fixing component 30 which has the protrusion part 33 shown in example two. In this case, the effects and manufacturing method are the same as in example two and thus an explanation is omitted here.

Embodiment Two

Figure 8:
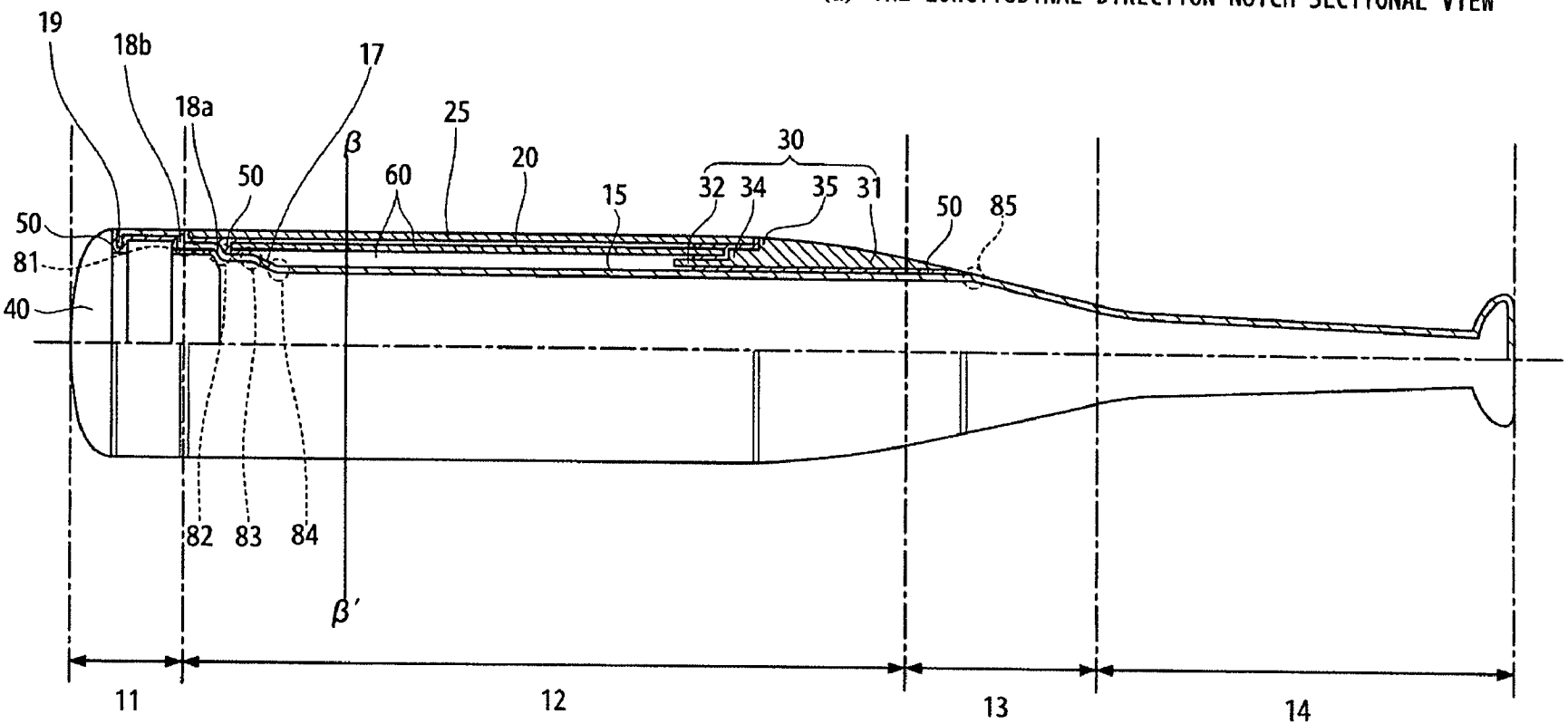
FIG. 8(*a*) shows a longitudinal direction notch sectional view of a bat for baseball or softball related to embodiment two of the present invention.
Figure 8:
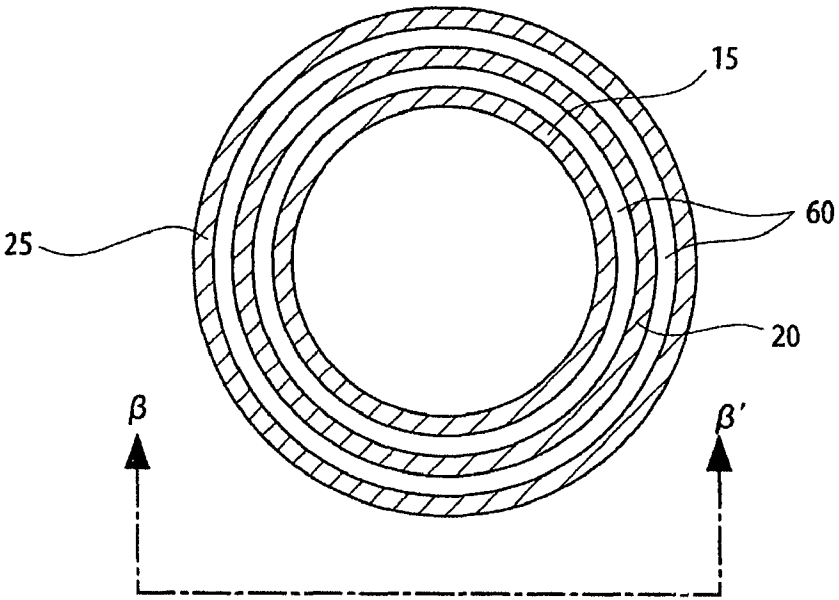

The bat for baseball or softball related to embodiment two of the present invention will be explained. As stated above, the bat for baseball or softball related to embodiment one of the present invention is a double layered bat which has a crevice 60. By forming the bat by fixing two thin metal tubes so that a crevice is formed, and when the thin metal tubes bend inwards when a ball is hit it is possible to reduce consumption of impact energy as ball transformation energy. By increasing the exterior tube 20 forming a three layered structure, it is possible to further reduce the thickness of each tube respectively. In addition, by a synergistic effect of the bending of each exterior tube it is possible to further increase the flight difference of a ball. The bat for baseball or softball related to embodiment two of the present invention is a three layered bat. FIG. 8 is a longitudinal direction notch sectional view and a cross sectional view of the line β-β' in a width direction of a bat for baseball or softball related to embodiment two of the present invention.

As is shown in FIG. 8, the bat for baseball or softball related to embodiment two of the present invention is comprised of a first tube 15, a second tube 20, a third tube 25, a fixing component 30 and a cap 40. The third tube 25 is added to the bat for baseball or softball related to embodiment one of the present invention and thus there is no large difference between the structure which is explained in the preferred embodiment. However, because the structure of the first tube 15 and the fixing component 30 is changed to correspond with the three layered bat, this point will be explained in detail. Furthermore, because the same parts as those of the bat for baseball or softball related to embodiment one of the present invention have the same symbols, an explanation will be omitted here.

In order to latch the two exterior tubes (second tube 20 and third tube 25) of the three layered bat, the first tube 15 of the bat for baseball or softball related to embodiment two of the present invention has a first stopper part 18*a*, a second stopper part 18*b* and a step part 17. Each of these parts is manufactured by reducing or expanding their respective diameters by a swaging process etc, in the same way as the bat for baseball or softball related to embodiment one of the present invention. However, for example, after forming the second stopper part 18*b* in a first place the first stopper part 18*a* is formed by reducing the certain height (that is, reducing the certain diameter) in a second place 82 (not shown in the diagram) in the case where manufacturing is performed by a diameter reducing process. This certain height is equal to the height of the crevice 60 which is formed between the third tube 25 and the second tube 20 in addition to the thickness of the second tube 20.

Furthermore, the step part 17 is formed by gradually reducing the certain height (diameter) of the first tube 15 in the direction of the grip end from a third place 83 which is a certain length from the first stopper part 18*a* towards the grip end up to a fourth place 84. The certain height at this time is the height of the crevice 60 which is formed between the second tube 20 and the first tube 15. The impact part 12 is formed by extending the same diameter of the first tube 15 from the fourth place 84 up to a fifth place 85 and the taper part 13 and the grip part 14 are formed by further reducing the diameter of the first tube 15 from the fifth place 85. The process which formed the curled part 19 on the tip part 11 is the same as in the bat for baseball or softball related to embodiment one of the present invention. In addition, the length of the curled part 19 can be any length as long as it is sufficient to latch the cap 40 which is later inserted by press fit processing. The length of the curled part 19 is about 3 mm-10 mm or more preferably about 5 mm.

The fixing component 30 includes a body part 31, an insertion part 32, a first stopper part 34 and a second stopper part 35. The first stopper part 34 and the second stopper part 35 are formed in a step-like shape from the insertion part 32 which has a certain thickness (equal to the height of the crevice 60 which is formed between the second tube 20 and the first tube 15 stated above) which is different to the fixing component 30 in embodiment one of the present invention. The height of the first stopper part 34 which is formed in a step-like shape is a sum of the height of the crevice 60 which is formed between the second tube 20 and the third tube 25 and the thickness of the second tube 25. In addition, the height of the second stopper part 35 is set at a height roughly equivalent to the thickness of the third tube 25. In this way, the crevice 60 of a certain height is formed between the third tube 25 and the second tube 20 and also between the second tube 20 and the first tube 15. In addition, the exterior surface of the third tube 25 and the exterior surface of the fixing component 30 are formed as one surface. Furthermore, the height of the crevice 60 is appropriately set according to the material used in the first tube 15, the second tube 20 and the third tube 25. In embodiment two of the present invention, the height of the crevice 60 is set, for example, between about 0.1 mm-3.0 mm.

The first tube 15, the second tube 20 and the third tube 25 of the three layered bat of embodiment two are cylindrical metal tubes which have two open ends respectively. The first tube 15 and the second tube 20 are generally formed from an aluminum alloy or steel alloy in order to secure lightness and strength. From the viewpoint of ease of processing and cost, the material is preferably an A7000 aluminum alloy such as aluminum alloy AA7050, AA7046 regulated under the American Aluminum Association Regulation. In addition the third tube 25 can be formed from an aluminum alloy or steel alloy the same as the first tube 15 or from a material such as titanium, a titanium alloy or magnesium alloy which are light and have excellent rebound characteristics. Furthermore, the third tube 25 can be formed from a phosphor bronze, a copper alloy, a gold alloy, or a platinum alloy. Preferably, the third tube 25 is formed from one of titanium, a titanium alloy, a magnesium alloy or a steel alloy. Furthermore, the thickness of the first tube 15, the second tube 20 and the third tube 25 related to embodiment two is formed thinner than the thickness of the first tube 15 and the second tube 20 of the bat for baseball or softball relate to embodiment one of the present invention. This is because the bat is three layered and in order to lighten each tube and make the entire bat a predetermined weight. In addition, because the bat has three layers and because it is possible to secure a certain strength by the three tubes, it is possible to lighten the bat by making each one of the tubes thinner.

By making the bat for baseball or softball related to embodiment two a three layered structure it is possible to further reduce the thickness of each exterior tube and it is also possible to further improve the flight distance of a ball by a synergistic effect of the bending of each of the tubes. In addition, the effects of improving safety, increasing the length of the life cycle of the bat compared to a hybrid type bat, improving rigidity of the bat tip part and increasing durability, are the same as the above stated embodiment one. Furthermore, because two stopper parts 18 are formed in the processing of the first tube 15, the number of processes increases, however, because it is a process which is machine controlled, there are hardly any effects. The three layered bat related to embodiment two can reduce operational processes compared to a conventional hybrid bat and the bat cited in Patent Document three.

Furthermore, the bat for baseball or softball related to embodiment two can also be transformed into example one, example two and example three of the bat for baseball or softball related to embodiment one stated above. That is, the tip part 11 is formed by the first tube 15 and the cap 40 is omitted, the protrusion part 33 is arranged on the fixing component 30, the latching of the second tube 20 and the third tube 25 is further strengthened and it is possible to omit forming the step part 17 of the first tube 15 by using the spacer 52. In addition, the effects of each are the same as the transformation example of the bat for baseball or softball related to embodiment one.

Embodiment Three

Figure 9:
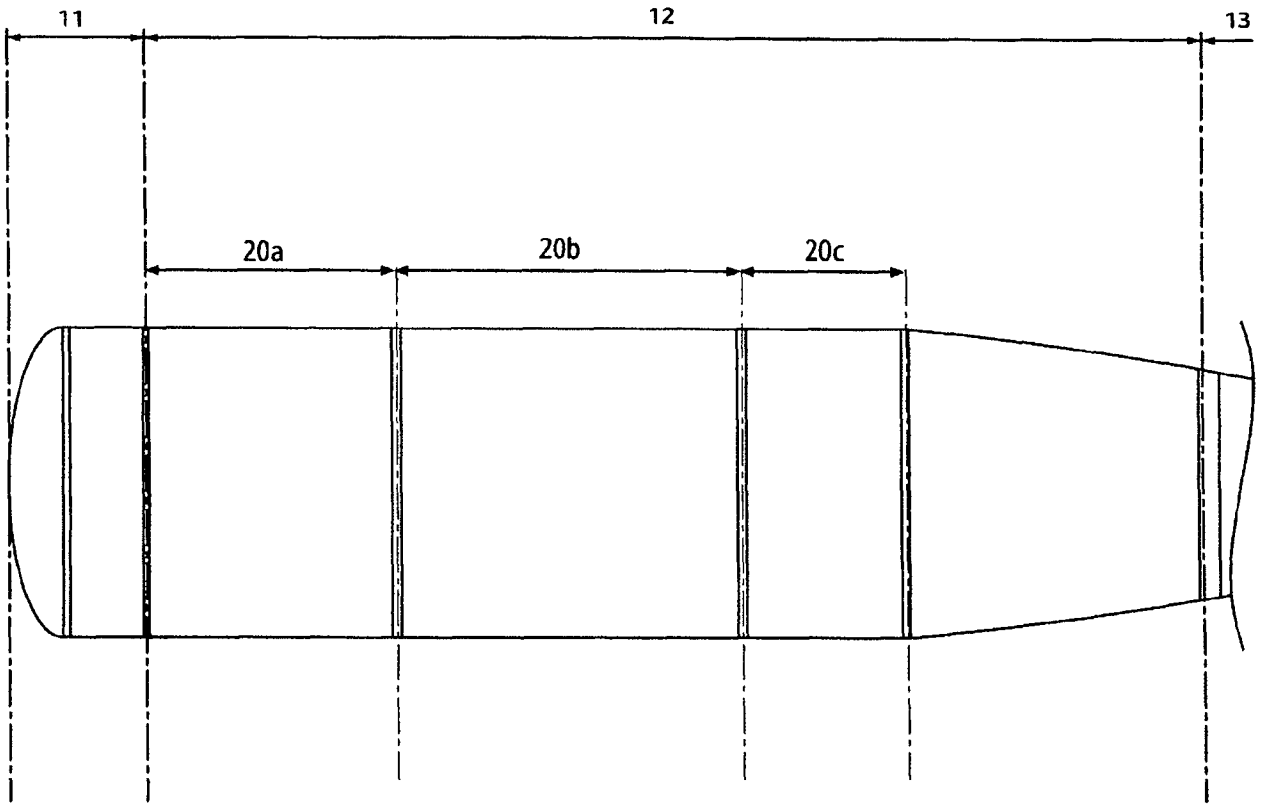
FIG. 9(*a*) shows a longitudinal direction surface view of a bat for baseball or softball related to embodiment three of the present invention.
Figure 9:
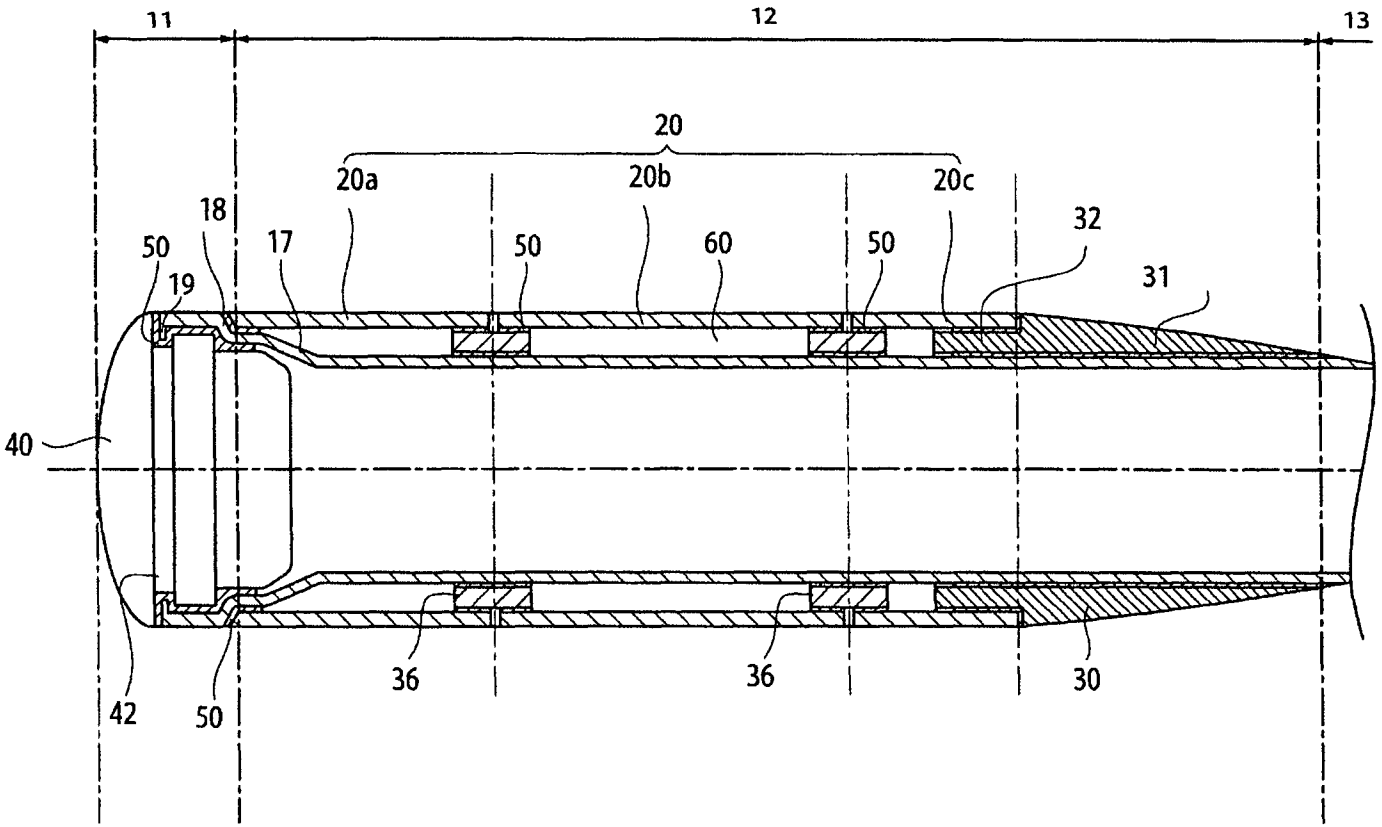

The bat for baseball or softball related to embodiment three of the present invention will be explained. As stated above, the bat for baseball or softball related to embodiment one of the present invention is a double layered bat arranged with a crevice 60 between an exterior tube 20 (second tube) and a first tube 15. By this structure it is possible to reduce consumption of impact energy as ball transformation energy when the thin metal tubes bend inwards when a ball is hit. And, by using a material which has excellent rebound characteristics as the material of the exterior tube 20 (second tube), for example, titanium or a titanium alloy, the bat is further constructed to improve the flight distance of a ball. However, this titanium or titanium alloy is expensive and if the entire second tube 20 is formed form titanium or a titanium alloy, manufacturing costs increase significantly. Therefore, if the exterior tube 20 (second tube) is formed from a plurality of tubes and titanium or a titanium alloy is used only on a sweet spot which is the center of an impact with a ball, then an increase in costs can be controlled. The bat for baseball or softball related to embodiment three is a bat which has a double layered structure having an exterior tube 20 which is comprised of a plurality of tubes. FIG. 9 is a longitudinal direction surface view and a longitudinal direction notch sectional view of a bat for baseball or softball related to embodiment three of the present invention.

As is shown in FIG. 9, the bat for baseball or softball related to embodiment three is comprised of a first tube 15, a second tube 20 which is comprised of three tubes (second tube A20*a*, second tube B20*b* and second tube C20*c*), a fixing component 30 and a cap 40. In addition, in order to latch the three tubes of the second tube 20 while forming the crevice 60, a second fixing component 36 is used. Because the first tube 15, the fixing component 30 and the cap 40 are the same as in the bat for baseball or softball related to embodiment one of the present invention stated above, the same parts have the same symbols and an explanation is omitted here.

The second tube 20 of the bat for baseball or softball related to embodiment three is comprised of three tubes, second tube A20*a*, second tube B20*b* and second C20*c* as shown in FIG. 9. However, FIG. 9 is only an example and the number of second tubes is not limited to three. In embodiment three, the second tube A20*a* and the second tube C20*c* are formed from the same material as the first tube 15, namely an aluminum alloy or a steel alloy. From the viewpoint of ease of processing and cost, the material of the first tube 15 is preferably an A7000 aluminum alloy such as aluminum alloy AA7050, AA7046 regulated under the American Aluminum Association Regulation. The second tube B20*b* is the part which is equivalent to what is called the sweet-spot where the ball travels furthest when hit, and is formed from high cost titanium or a titanium alloy which has excellent rebound characteristics. The second tube B20*b* may be formed from a magnesium alloy, phosphor bronze, a copper alloy, a gold alloy, or a platinum alloy etc. The plurality of second tubes are cylindrical and each tube formed with two ends which are open. The second tubes are each heat treated separately and used once stress is released. Furthermore, either the second tube A20*a* or the second tube C20*c* may be formed from the same material as the second tube B20*b*. As a result, at least one of the three second tubes (20*a*, 20*b*, 20*c*) is formed from a different material to the other two tubes. In addition, the three second tubes (20*a*, 20*b*, 20*c*) are formed to the same thickness.

The second fixing component 36 is a convex fixing component in a cross section longitudinal direction and is formed from a resin the same as the fixing component 30. More specifically, the second fixing component 36 is formed from a plastic or synthetic rubber such as polyurethane, polyamide or polyethylene or a different elastomer material, however, the material of the second fixing component 36 is not limited to this. A synthetic resin, metal or ceramic may also be used. The second fixing component 36 is preferably formed from a material having soundproof characteristics so that a metal sound is not produced when the first tube 15 and the three second tubes 20 contact when a ball is hit.

Here, the bottom part (not shown in the diagram) of the second fixing component 36 has a certain thickness and this thickness is equivalent to the height of the crevice 60 which is formed between the first tube 15 and the plurality of the second tubes 20. Furthermore, the bottom part of the second fixing component 36 plays a role equivalent to a fulcrum of a spring when the second tube 20 bends when a ball is hit. In addition, the convex shaped protrusion part (not shown in the diagram) of the second fixing component 36 also has a certain height which is equivalent to the thickness of each of the three second tubes 20 (20*a*, 20*b*, 20*c*). Therefore, the crevice 60 with a certain height is formed between the first tube 15 and the plurality of second tubes 20 in the case where the three second tubes 20 (20*a*, 20*b*, 20*c*) are fixed to the exterior periphery of the impact part 12 of the first tube 15 via the second fixing component 36 and the adhesive 50. In addition, the exterior surface of the three second tubes 20 (20*a*, 20*b*, 20*c*), the tip part 11 and the taper part 13 of the first tube 15 and the upper surface of the convex shaped protrusion of the second fixing component 36 are formed as the same surface.

Next, the attachment method of the three second tubes 20 (20*a*, 20*b*, 20*c*) will be explained. A first tube 15 is formed in the same way as the bat for baseball or softball related to embodiment one of the present invention stated above. Next, using two fixing components 36, the three second tubes 20 (20*a*, 20*b*, 20*c*) are fixed via the second fixing components 36 and the adhesive 50. In this way, the three second tubes 20 (20*a*, 20*b*, 20*c*) become one second tube 20. This process can be performed before the processing of the first tube 15 and can also be performed in parallel to the processing of the first tube 15 by a different production line. Next, the second tube 20 which has become one tube is attached to the exterior periphery of the impact part 12 of the first tube 15 from the grip end side of the first tube 15. At this time, the adhesive 50 is applied to the exterior surface from the step part 17 of the first tube 15 to the stopper part 18 and also applied to the bottom surface of the second fixing component 36. Next, the adhesive 50 is applied to the bottom surface of the body part 31 of the fixing component 30 and the entire surface of the insertion part 32 and the fixing component 30 is inserted between the first tube 15 and the second tube 20 from the grip end side of the first tube 15. When the adhesive 50 hardens, the second tube 20 is fixed to the impact part 12 of the first tube 15 and a double layered bat having three second tubes 20 (20*a*, 20*b*, 20*c*) is formed. Because the process of press fitting the cap 40 is the same as embodiment one stated above and explanation is omitted here.

In the bat for baseball or softball related to embodiment three of the present invention which has the structure explained above, by arranging the second tube 20*b* which is formed from titanium or a titanium alloy having excellent rebound characteristics only in a sweet-spot position which when hit can increase the flight distance of a ball, it is possible to reduce and increase in manufacturing costs even if expensive titanium or a titanium alloy is used. In addition, it is possible to form the other second tubes (20*a*, 20*c*) with a cheaper metal such as a steel alloy and thus it is possible to propose a two layered bat in which a reduction in manufacturing costs can easily be overlapped.

Furthermore, the second tube 20*b* which has excellent rebound characteristics is arranged only on the sweet-spot part and the other second tubes (20*a*, 20*c*) for example, can be formed with a metal which has poorer rebound characteristics than an aluminum alloy or a steel alloy. In this case, the bat becomes a bat in which a ball does not travel as far if hit in a place other than this sweet-spot, however, this bat can be preferably used as a practice bat for batting skill acquisition.

In addition, the effects of increasing the flight distance of a ball by a double layered structure, reducing operational processes, improving safety, increasing the length of the life cycle of the bat compared to a hybrid type bat, increasing durability and improving rigidity of the bat tip part, are the same as in the above stated embodiment one and embodiment two of the present invention and an explanation is omitted here. Furthermore, a transformed example is possible as in embodiment one and embodiment two of the present invention stated above wherein the cap 40 can be omitted by forming the tip part 11 with the first tube 15, latching of the second tube 20 can be strengthened by arranging a convex shaped protrusion on the fixing component 30 and formation of the step part 17 of the first tube 15 can be omitted by using the spacer 52. In addition, each of these effects is the same as in the transformed examples of the bat for baseball or softball related to embodiment one stated above.

Embodiment Four

Figure 10:
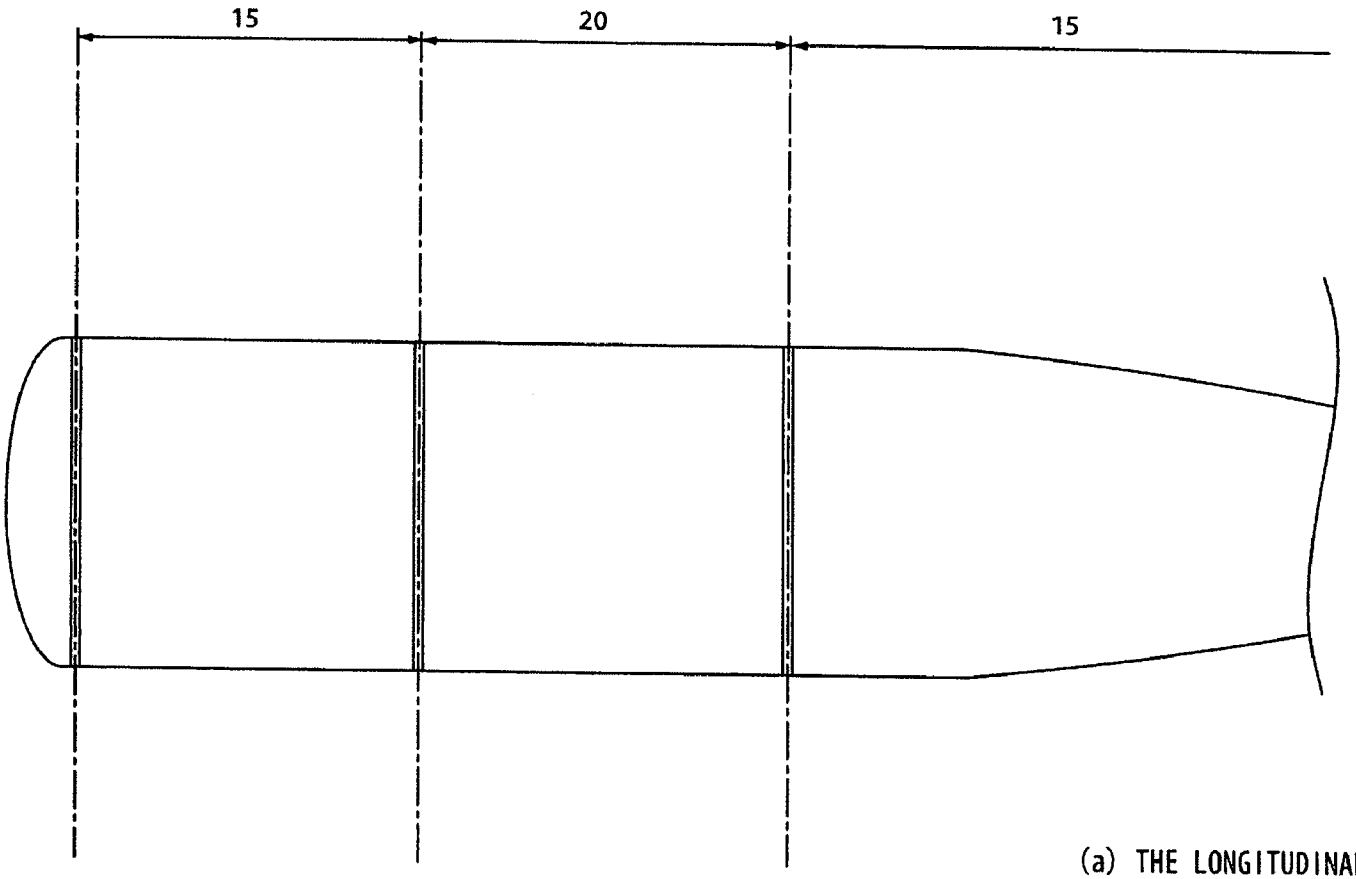
FIG. 10(*a*) shows a longitudinal direction surface view of a bat for baseball or softball related to embodiment four of the present invention.
Figure 10:
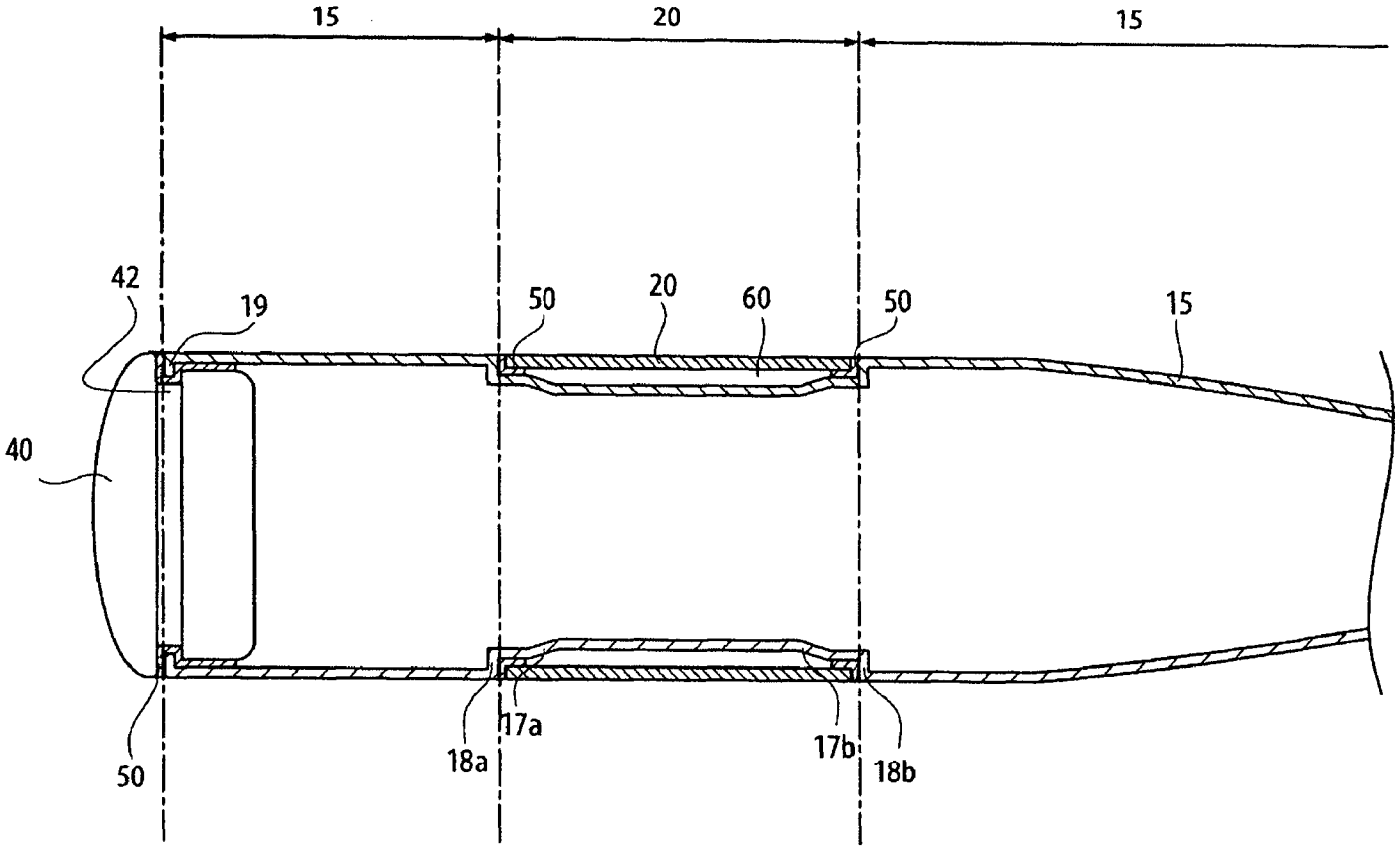
Figure 11:
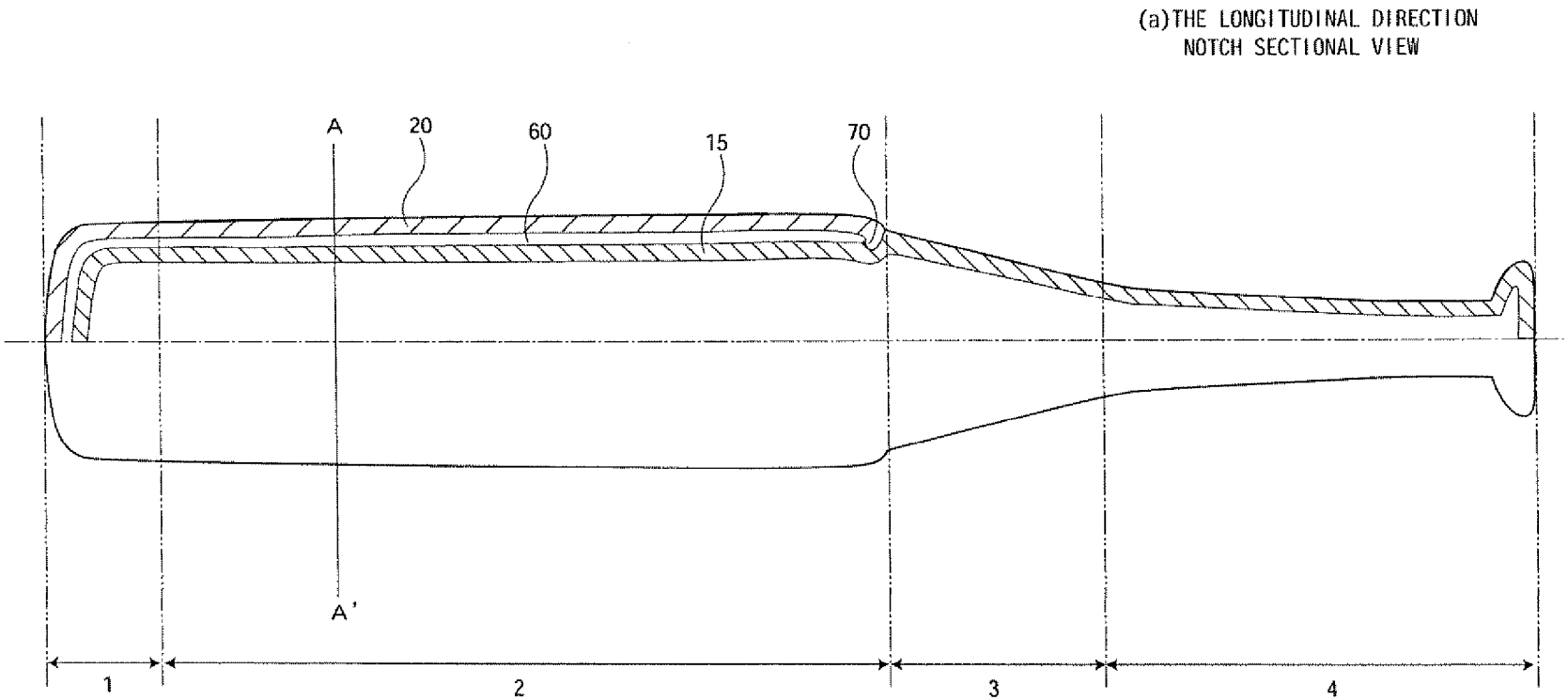
Fig.11 (a) PRIOR ART
FIG. 11(*a*) shows a longitudinal direction notch sectional view of one example of a double layered bat.
Figure 11:
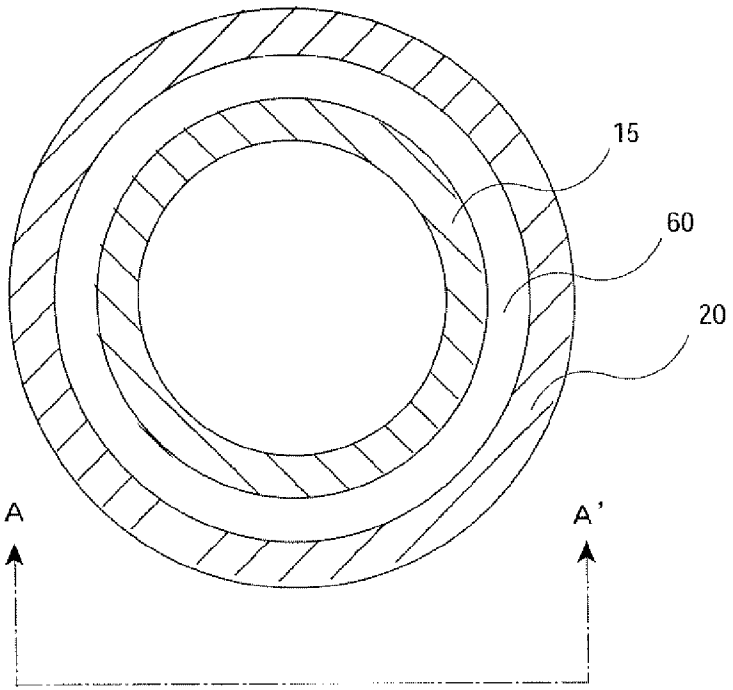
Fig.11 (b) PRIOR ART
Figure 12:
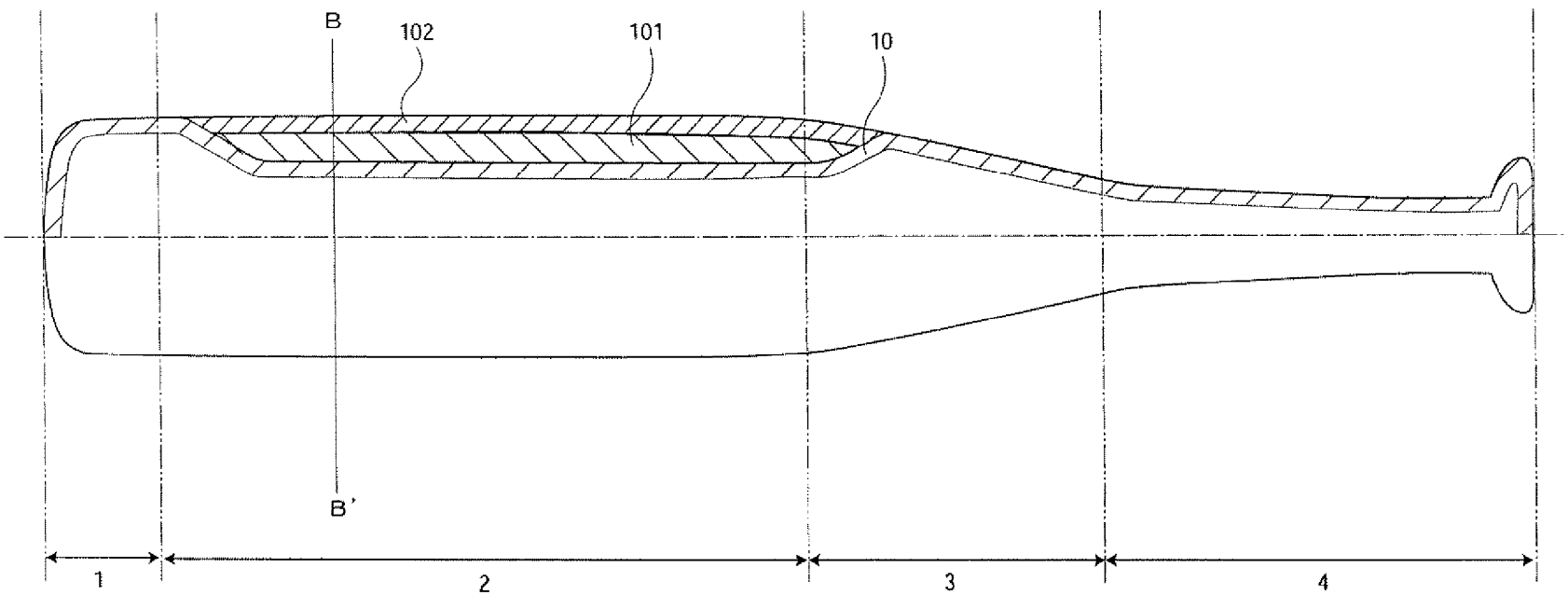
Fig.12 (a) PRIOR ART
FIG. 12(*a*) shows a longitudinal direction notch sectional view of one example of a hybrid type double layered bat.
Figure 12:
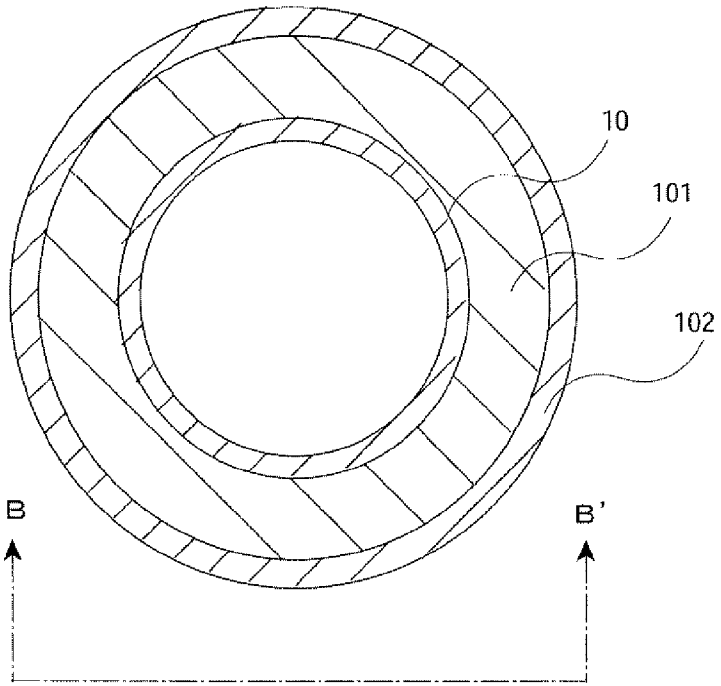
Fig.12 (b) PRIOR ART

Next, the bat for baseball or softball related to embodiment four of the present invention will be explained. As stated above, the second tube 20 in the double layered bat related to embodiment three of the present invention is comprised of a plurality of tubes and the second tube 20*b* which is formed from titanium or a titanium alloy having excellent rebound characteristics, is arranged in the sweet-spot position. In the bat for baseball or softball related to embodiment four of the present invention, the arrangement of the second tube 20 which is formed from titanium or a titanium alloy having excellent rebound characteristics in the sweet-spot position is the same as in embodiment three, however, in embodiment four this second tube 20 is comprised from one tube. FIG. 10 is a longitudinal direction surface view and a longitudinal direction notch sectional view of a bat for baseball or softball related to embodiment four of the present invention.

As is shown in FIG. 10, the bat for baseball or softball related to embodiment four of the present invention is comprised of a first tube 15, a second tube 20 and a cap 40. That is, unlike the bat for baseball or softball related to embodiment one, two and three of the present invention, there is no need for a fixing component 30. The second tube 20 is latched by two stopper parts (18*a*, 18*b*) which are arranged on the first tube 15.

In the bat for baseball or softball related to embodiment four of the present invention, the second tube 20 is short, about half the length of the impact part 12 of the first tube 15. Two step parts 17 and two stopper parts 18 (first step part 17*a* and second step part 17*b*, first stopper part 18*a* and second stopper part 18*b*) of the first tube 15 are formed and the distance from the bat tip to the first stopper part 18*a* is extended. In this way, the length of the second tube 20 which is attached and fixed between the first stopper part 18*a* and second stopper part 18*b* of the first tube 15 can be reduced. Furthermore, the cap 40 does not include a cap second fixing component 44. Because the other parts are the same as in the bat related to embodiment one stated above, the same parts have the same symbols and an explanation is omitted here.

Next, the formation method of the first tube 15 of the bat related to embodiment four will be explained. The material and thickness of the first tube 15 and the second tube 20 are the same as in embodiment one stated above therefore an explanation is omitted here. The first tube 15 is formed by a combination of diameter reducing and diameter expanding by a swaging process for example and this is different to the formation of the first tube 15 of the bat related to embodiments one, two and three of the present invention stated above.

First, a cylindrical tube (first tube 15) having two ends which are open and which has a diameter within the range regulated by baseball regulations is prepared. Next, the diameter of the tube is reduced by a certain height (diameter) at a first place of a certain distance from one end of the tube. This first place is the first stopper 18*a*. The sweet-spot position of the double layered bat which is formed is set as a base and this distance is decided taking the material etc of the first tube 15 and second tube 20 into consideration. In addition, the certain height is equivalent to the thickness of the second tube 20.

Next, a diameter of the tube is smoothly reduced a certain height (diameter) by processing from a second place (not shown in the diagram) a certain distance from the first stopper 18*a* towards the grip end up to a third place (not shown in the diagram). The first step part 17*a* is the part between this second place and third place and the certain height is equivalent to the height of a crevice 60 which is formed between the first tube 15 and the second tube 20.

Furthermore, the diameter of the first tube 15 is processed at the same diameter from the third place a certain distance up to a fourth place (not shown in the diagram) towards the grip end. Next, the diameter of the first tube 15 is smoothly expanded a certain height (diameter) from the fourth place up to a fifth place (not shown in the diagram). The part from the fourth place to the fifth place is the second step part 17*b*. Furthermore, this height is equivalent to the height of a crevice 60 which is formed between the first tube 15 and the second tube 20.

Next, an adhesive 50 is applied to the exterior surface of this tube between the first stopper part 18*a* and the first step part 17*a*. And the adhesive 50 is applied to the exterior surface of the tub from the second step part 17*b* a certain distance up to a sixth place towards the grip end. Then, before the adhesive 50 hardens, this tube is inserted from the other end of the tube towards the first stopper part 18*a* within the second tube 20 which is formed in advance to a length corresponding to the distance of the sweet-spot.

Here, the exterior diameter of the second tube is the same as the exterior diameter of the part between one end of the above stated tube (first tube 15) and the first place. In addition, the interior diameter of the second tube is a slightly larger than the exterior diameter between the first stopper part 18*a* and the second place which are formed on the above stated tube (first tube 15), and slightly larger than the exterior diameter between the fifth place and the sixth place. Therefore, the second tube 20 covers the exterior surface of the first tube 15 from the first stopper part 18*a* up to the sixth place and the exterior surface of the tip part 11 of the first tube 15 and the exterior surface of the second tube 20 are formed into one surface.

After the adhesive 50 hardens and the second tube 20 is fixed to the exterior periphery of the impact part 12 of the first tube 15, the diameter of the first tube 15 is further expanded a certain height (diameter) in the sixth place. The sixth place is the second stopper part 18*b* and the position of the sixth place is the position of an end part (other end part) which is located on the opposite side of an end part of the first stopper part 18*a* side of the second tube 20 which is attached. In addition, the certain height is a height equivalent to the thickness of the second tube 20. In this way, the other end of the second tube 20 is latched by the adhesive 50 between the second step part 17*b* and the second stopper part 18*b*. In addition, the second tube 20 is prevented from moving back and forth by the first stopper part 18*a* and the second stopper part 18*b*. Then, a crevice 60 having a certain height is formed by the first step part 17*a* and the second step part 17*b* between the impact par 12 of the first tube 15 and the second tube 20.

Furthermore, after this a taper part 13 and a grip part 14 are formed by a diameter reducing process and when lastly the grip end is formed by a spinning process, the first tube 15 is formed. After this, the first tube 15 is heated while the second tube 20 is still attached, stress in released and the bat having a certain strength is formed. This heat treatment should be applied to the first tube 15 and preferably should be performed by controlling the temperature so that there is no effect on the adhesive 50 which has hardened. Because heat treatment is not performed simultaneously on both the first tube 15 and the second tube 20 which have different materials as in the bat shown in Patent Document one, control of the heat treatment process is easy. Next, when the cap 40 is processed by press fitting the bat related to embodiment four is completed. Furthermore, because the cap 40 can secure a sufficient length of the cap fixing component 43, there is no need to form the second fixing component 44.

The bat related to embodiment four having the above described structure has a structure in which the second tube 20 is only attached to the position of the sweet-spot as can be judged from the notch cross section in FIG. 10(*b*). That is, because a tube which is formed from a metal having excellent rebound characteristics is used only on the part which makes a ball travel far when hit, an increase in manufacturing costs can be reduced.

In addition, the effects of increasing the flight distance of a ball by a double layered structure having a crevice 60, improving rigidity of the bat tip part, improving safety, increasing the length of the life cycle of the bat compared to a hybrid type bat and increasing durability are the same as in the bat in the above stated embodiment one, embodiment two and embodiment three of the present invention.

However, Because the first tube 15 of the bat related to embodiment four is formed by a combination of a diameter reducing process and a diameter expanding process, the operational processes increase compared to the bat related to embodiments one, two and three of the present invention.

Furthermore, the bat related to the present embodiment can be transformed as an example the same as in the above stated example one and example three of the embodiment one of the present invention. The effects in this case are also the same. In addition, as explained in embodiment three, the first tube 15 can be formed from a metal which has poorer rebound characteristics than an aluminum alloy a steel alloy and can be used as a practice bat for batting skill acquisition. The effects in this case are also the same.

What is claimed is:

1. A bat for baseball or softball comprising:

a first tube being formed from an aluminum alloy or an alloy steel and having a grip part, a taper part, an impact part, a tip part, a step part having a larger exterior diameter than an exterior diameter of said impact part and said first tube also including a stopper part having a larger exterior diameter than said exterior diameter of said step part;

a cylindrical second tube being formed from titanium, a titanium alloy, a magnesium alloy or an alloy steel and having two ends which are open, and having an interior diameter which is larger than said exterior diameter of said step part of said first tube and smaller than said exterior diameter of said stopper part of said first tube;

a fixing component including a body part and an insertion part, said insertion part being inserted between said first tube and said second tube, said fixing component latching said second tube to an exterior periphery of said first tube; and a crevice located between said first tube and said second tube, said crevice being formed by said second tube being attached to an exterior periphery of said impact part of said first tube, one end of said second tube being fixed between said step part of said first tube and said stopper part by an adhesive, and the other end of said second tube being fixed by said adhesive with said insertion part of said fixing component, said fixing component being inserted between said second tube and said first tube.

2. The bat for baseball or softball according to claim 1, further comprising a cap, said cap having a cap tip part, a recessed part and a fixing part, a tip of said tip part of said first tube having a curled part which curves inwards, an exterior diameter of said fixing part of said cap being smaller than an interior diameter of said first tube from said curled part to said stopper part, and an exterior diameter of said recessed part of said cap being smaller than an interior diameter of said curled part of said first tube and said recessed part being latched by said curled part.

3. The bat for baseball or softball according to claim 1, wherein a tip of said tip part curves inwards and is closed.

4. The bat for baseball or softball according to claim 1, further comprising a spacer, said spacer being inserted between said first tube and said second tube, said first tube includes said stopper part having a larger exterior diameter than an exterior diameter of said impact part and a larger exterior diameter than an interior diameter of said second tube, and said second tube is attached to an exterior periphery of said impact part of said first tube, and one end of said second tube is fixed to a tip of a tip part side of said impact part of said first tube by said adhesive and said spacer, and the other end of said second tube being fixed by said adhesive with said insertion part of said fixing component, said fixing component being inserted between said second tube and said first tube, and said crevice being formed between said first tube and said second tube.

5. The bat for baseball or softball according to claim 2, wherein said first tube includes a groove in a place of a taper part side of said impact part, said fixing component further having a protrusion part on a side in which said insertion part faces said first tube, said fixing component being inserted between said first tube and said second tube, and said protrusion part being fitted with said groove of said first tube.

6. The bat for baseball or softball according to claim 1, wherein said first tube further includes a second step part having a larger exterior diameter than an exterior diameter of said impact part, said exterior diameter of said second step part being smaller than an interior diameter of said second tube, and also includes a second stopper part having a larger exterior diameter than said exterior diameter of said second step part, said exterior diameter of said second stopper part being larger than said interior diameter of said second tube, said second tube is attached to an exterior periphery of said impact part of said first tube, and wherein one end of said second tube is fixed by said adhesive between said step part of said first tube and said stopper part of said first tube, the other end of said second tube is fixed by said adhesive between said second step part of said first tube and said second stopper part of said first tube, and said second stopper part is formed so that said second stopper part has a larger exterior diameter than an interior diameter of said second tube after said second tube is fixed between said stopper part and said step part and also between said second step part and said second stopper part.

7. The bat for baseball or softball according to claim 1, wherein said stopper part is formed in a position at least 100 mm or more from a tip of said tip part of said first tube, and said second tube is arranged in the best position for an impact.

* * * * *